US007548703B2

(12) United States Patent
Kabashima

(10) Patent No.: US 7,548,703 B2
(45) Date of Patent: Jun. 16, 2009

(54) IMAGE FORMING APPARATUS ADMINISTRATION SYSTEM WITH DEVELOPER DENSITY DETECTION AND DEVELOPER LIFETIME INFORMATION COMMUNICATION FEATURES

(75) Inventor: Toru Kabashima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 449 days.

(21) Appl. No.: 11/452,207

(22) Filed: Jun. 14, 2006

(65) Prior Publication Data

US 2006/0285860 A1 Dec. 21, 2006

(30) Foreign Application Priority Data

Jun. 21, 2005 (JP) ..... 2005-180523

(51) Int. Cl.
*G03G 15/08* (2006.01)
*G03G 15/00* (2006.01)

(52) U.S. Cl. ..... 399/27; 399/49

(58) Field of Classification Search ..... 399/29, 399/27, 49, 60
See application file for complete search history.

(56) References Cited

U.S. PATENT DOCUMENTS

| | | | | |
|---|---|---|---|---|
| 5,237,370 | A | 8/1993 | Murai | |
| 5,475,476 | A | 12/1995 | Murai et al. | |
| 5,682,572 | A | 10/1997 | Murai et al. | |
| 5,722,007 | A * | 2/1998 | Ogata et al. | 399/49 |
| 6,124,067 | A * | 9/2000 | Mikuriya et al. | |
| 6,519,434 | B2 * | 2/2003 | Izumi et al. | |
| 6,526,237 | B2 * | 2/2003 | Endo | 399/49 |
| 6,605,165 | B2 | 8/2003 | Kunishi et al. | |
| 6,917,767 | B2 | 7/2005 | Kabashima | |
| 6,917,776 | B2 | 7/2005 | Kabashima et al | |
| 2004/0223776 | A1 * | 11/2004 | Ishida | 399/49 |
| 2006/0285860 | A1 | 12/2006 | Kabashima | |

FOREIGN PATENT DOCUMENTS

| | | | |
|---|---|---|---|
| JP | 5-289494 | A | 11/1993 |
| JP | 8-314815 | A | 11/1996 |
| JP | 11-15338 | A | 1/1999 |
| JP | 2001-117295 | A | 4/2001 |
| JP | 2001-296706 | | 10/2001 |
| JP | 2004-233826 | | 8/2004 |

* cited by examiner

*Primary Examiner*—Susan S Lee
(74) *Attorney, Agent, or Firm*—Fitzpatrick, Cella, Harper & Scinto

(57) ABSTRACT

An image forming apparatus including an electrostatic image forming device, which forms an electrostatic image on an image bearing member, a developing apparatus, which develops the electrostatic image by a development bias being applied to a developer carrying member carrying a developer, a distance changing device, which changes the closest distance between the image bearing member and the developer carrying member, a density detecting portion, which detects the density of a developer image for detection formed by the developing apparatus, and a controller operable to execute a developer lifetime detecting mode for detecting the developer image for detection formed with the closest distance changed by the distance changing device, by the density detecting portion, and informing information regarding the lifetime of the developer based on the result of this detection.

2 Claims, 17 Drawing Sheets

IMAGE FORMING APPARATUS ADMINISTRATION SYSTEM WITH DEVELOPER DENSITY DETECTION AND DEVELOPER LIFETIME INFORMATION COMMUNICATION FEATURES

BACKGROUND OF THE INVENTION

1. Field of the Invention

The invention relates to an image forming apparatus such as, for example, a copying machine, a facsimile apparatus or a printer of an electrophotographic printing type, and an image forming apparatus administration system.

2. Related Background Art

In offices, there are handled many office automation (GA) apparatuses including image forming apparatuses such as, for example, copying machines and facsimile apparatuses.

An image forming apparatus has replaceable parts such as an image bearing member such as an electrophotographic photosensitive member, a developer, a sheet feeding roller and a fixing roller and therefore, after the use thereof for a predetermined period, it is necessary to replace these parts. However, the timing for replacing the parts differs greatly depending on a user s use condition such as, for example, the use environment, the kind of transfer paper, the number of used sheets per day, or the image percentage of an image. Further, there is also the irregularity of the qualities of the replaceable parts.

Accordingly, when only a lifetime shorter than estimated is reached, the image forming apparatus is stopped and there occurs a time during which the user cannot use the apparatus, and this leads to the possibility that the operable time of the image forming apparatus may be reduced.

In recent years, the higher efficiency of work has been advanced and importance has been attached to the operable time of the image forming apparatus and particularly, in an image forming apparatus of a high speed (100 ppm or greater), there has been required such high productivity that the apparatus does not stop for 10 hours on end.

To solve this problem, there are proposed various techniques at present.

In Japanese Patent Application Laid-open No. 2001-117295, at a position downstream of the opposed position of a photosensitive drum to a developing sleeve with respect to the rotation direction thereof, a developer in a developing device is made replaceable with a fresh developer so that a detected potential may be maintained at a set potential in accordance with the surface potential of the photosensitive drum detected by a potential sensor.

Accordingly, the degree of deterioration of the developer is judged, and in accordance with the degree of deterioration, the developer in a developer container is automatically replaced with a fresh developer, whereby images of high quality can be stably provided for a long period. Further, it is possible to greatly curtail running costs.

As the task of long lifetime development to be studied, there have been done the development of a developer extended in endurance lifetime and the development of a process which does not deteriorate the developer, and the lifetime of the developer at present is 30,000 to 50,000 sheets. A counter method which is a method whereby a serviceman periodically replaces the developer in accordance with a predetermined number of endurance test sheets is generally carried out to thereby enhance the rate of operation of the image forming apparatus.

Further, there is a technique of detecting the quantity of reflected light when a relatively large spotlight (having a spot diameter of several millimeters or greater) is applied to a patch pattern formed on an image bearing member (hereinafter referred to as the "patch detecting method"), thereby detecting the amount of toner adhering to the patch pattern. A technique of controlling image forming conditions such as an electrostatic latent image condition and a developing condition in accordance with the result of the detection of the afore-mentioned amount of toner is applied to actual commodities.

By detecting the amount of adhering toner on each density patch of a gradation pattern, it is possible to know harmony and solid density under the image forming conditions. Therefore, if the values of these depart from a prescribed range, the control of the image forming conditions is effected so as to obtain appropriate harmony in accordance with the result, and to provide appropriate solid density, and the harmony and the solid density can be modified. The controlled image forming conditions include the toner density of the developer (in the case of a dual-component developing process), a development bias, the speed of a developer carrying member, etc.

The deteriorated state of the developer is detected by the above-described patch detecting method to thereby control the developing conditions, extend the lifetime of the image forming apparatus and increase the operating time thereof.

Also, in Japanese Patent Application Laid-open No. H05-289494, the toner density of a developer in a developing device is detected, and when the fluctuation of an image due to the fluctuation of the toner density with time occurs, the development gap is suitably adjusted to thereby increase the operating time of an image forming apparatus.

In Japanese Patent Application Laid-open No. H08-314815, there is proposed an administration system for an image forming apparatus in which the image forming apparatus and a host computer in a business office taking charge of the maintenance or the like of the image forming apparatus are connected together by communicating means, and data such as count information transmitted from the image forming apparatus is received by a host computer, and the received data is analyzed and displayed on the host computer side.

For example, such an administration system for the image forming apparatus is designed such that the amount of toner consumed in the image forming apparatus is monitored on the host computer side, and when the toner in a toner supplying container for supplying the toner to developing means has become exhausted, and when it is detected that a toner collecting container for storing therein the toner collected from a photosensitive member has become full of the toner, a serviceman is instructed to replace the toner supplying container and the toner collecting container. As a result, such a situation can be coped with at real time in accordance with the state of the image forming apparatus to thereby enhance the operable time.

In Japanese Patent Application Laid-open No. 2001-296706, developing capability is synthetically inferred from the information of the operable time of a developing apparatus, toner density, the amount of consumed toner, etc., and one of the latent image forming condition, the toner supplying condition, etc. is selected and controlled to thereby cope with all changes with time, thus prolonging the operable time of an image forming apparatus.

Also, in Japanese Patent Application Laid-open No. H11-15338, the degree of deterioration of a developer is presumed from the density on a photosensitive member, load torque applied to a developing device and the permeability of a toner in a developer container, and the developing condition is changed to thereby extend the lifetime of the developer.

There are various disadvantages in the examples of the conventional methods described above.

a) In the potential sensor method of detecting the amount of toner on the photosensitive member described above, the state of the developer after already being deteriorated is detected, and this leads to the disadvantage that it is difficult to measure the degree of deterioration of the developer accurately and it is impossible to estimate the lifetime at the beginning to the middle of the operation.

b) In the judgment of the deterioration of the developer by the counter detecting method described above, the estimated accuracy of the lifetime of the developer is low and therefore, the user effected the use greatly exceeding the lifetime of the developer, and this leads to the fear that an image defect or the scattering of the developer in the machine may occur. There is also the disadvantage that the developer which is still usable is replaced.

c) In the patch detecting method described above, the developing state can be grasped, but there is the disadvantage that detection can be effected only after the developer has been deteriorated, and this limits taking countermeasures.

d) In the development gap adjusting method described above, it is impossible to detect beforehand how much the developer has been deteriorated, and it is necessary to provide a mechanism for adjusting, and this leads to the disadvantage that much expense is required.

e) In the detecting method by the host computer described above, only the amount of remaining toner is detected and reported to a server. However, the deterioration of the quality of image itself is not detected and therefore, the effect of curtailing the operating time by the user is low.

f) In the method of coping with the changes with time on the basis of multi-dimensional information, the other conditions are changed in an already deteriorated state and therefore, a change suddenly happening cannot be coped with, and there is the undesirable possibility that the operating time may be reduced.

g) In the method of presuming the deterioration of the developer from the load torque and the permeability, detection is effected in the state after already being deteriorated, and this leads to the undesirable possibility that the replacement timing of the developer may shift.

Against the above-noted disadvantages, it is ideally necessary that the developer, the photosensitive member, etc. be necessarily replaced when a certain operating time during which the quality of image is anticipated to be deteriorated at a development stage has been reached. However, as described above, means for the detection of the quality of image and the detection of the deterioration of each part concerned with the quality of image at present cope with only the procedure after deterioration or the transition of deterioration and therefore, are very low in reliability. Therefore, it is the present situation that the replacement time is unavoidably set short in view of the safety rate. Further, it is known that actually the operating conditions differ from one user to another and in conformity therewith, the replacement time of the developer, the photosensitive member, etc. which can ensure the quality of image differs greatly.

When the deterioration of the quality of image and the deterioration of the parts are detected beforehand and the deterioration has been confirmed, appropriately coping with maintenance will lead to the higher work efficiency of the maintenance, and an increase in the operable time of the image forming apparatus. For that purpose, the tolerance (hereinafter referred to as the "latitude") of a part itself to the deterioration of an image must be detected before the part reaches the end of its lifetime.

SUMMARY OF THE INVENTION

So, it is the object of the present invention to provide an image forming apparatus and an image forming apparatus administration system which can obtain precise information about the lifetime of a developer which is the main factor of the above-described image deterioration.

An image forming apparatus which is one of preferred forms for achieving the above object has:

electrostatic image forming means for forming an electrostatic image on an image bearing member;

a developing apparatus provided with a developer carrying member disposed in opposed relationship with the image bearing member and carrying a developer thereon, and applying a development bias to the developer carrying member to thereby effect the development of the electrostatic image;

distance changing means capable of changing the closest distance between the image bearing member and the developer carrying member;

density detecting means for detecting the density of a developer image for detection formed by the developing apparatus; and controlling means capable of executing a developer lifetime detecting mode for detecting the developer image for detection formed with the closest distance changed by the distance changing means, by the density detecting means, and notifying information about the lifetime of the developer by the result of the detection by the density detecting means.

Also, an image forming apparatus administration system which is one of the preferred forms for achieving the above object has:

an image forming apparatus provided with:

electrostatic image forming means for forming an electrostatic image on an image bearing member;

a developing apparatus provided with a developer carrying member disposed in opposed relationship with the image bearing member and carrying a developer thereon, and applying a development bias to the developer carrying member to thereby effect the development of the electrostatic image;

distance changing means capable of changing the closest distance between the image bearing member and the developer carrying member;

density detecting means for detecting the density of a developer image for detection formed by the developing apparatus;

controlling means capable of executing a developer lifetime detecting mode for detecting the developer image for detection formed with the closest distance changed by the distance changing means, by the density detecting means, and transmitting information regarding the lifetime of the developer to an administrating device through communicating means; and a terminal device for informing the information regarding the lifetime of the developer transmitted thereto from the administrating device through communicating means.

DESCRIPTION OF THE PREFERRED EMBODIMENTS

The manner in which the present invention is carried out will hereinafter be specifically described with reference to the drawings. While herein a plurality of embodiments of the present invention will be described, the present invention is not restricted to these embodiments.

Embodiment 1

Figure 1:
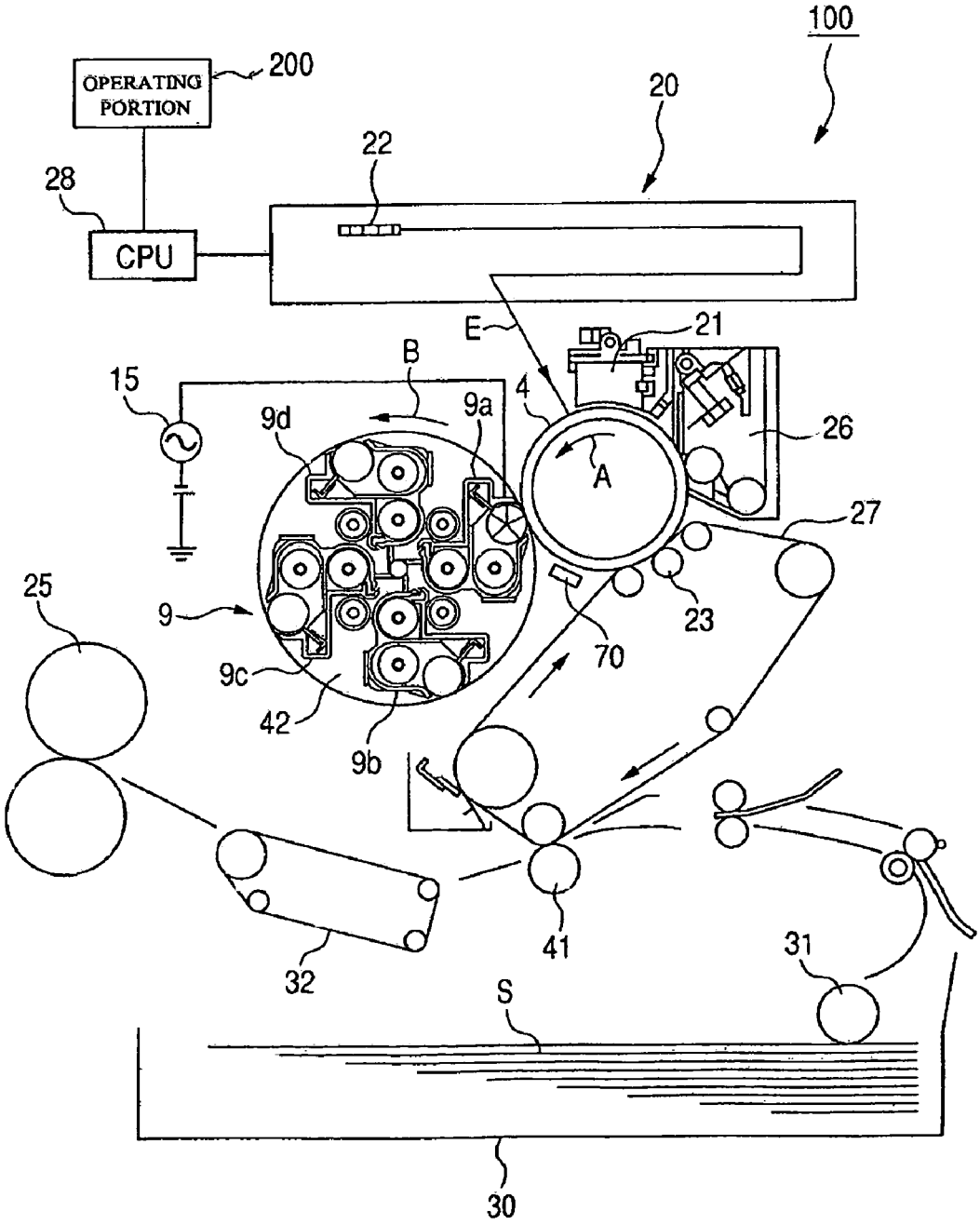
FIG. 1 schematically shows the construction of an embodiment of an image forming apparatus according to the present invention.

FIG. 1 schematically shows the construction of an embodiment of an image forming apparatus according to the present invention.

In the present embodiment, the image forming apparatus 100 is provided with an electrophotographic photosensitive member (hereinafter referred to as the "photosensitive drum") 4 as an image bearing member rotatably carried as latent image forming means, and a primary charger 21 and an exposing device 20 disposed around the photosensitive drum 4. The photosensitive drum 4 has its surface uniformly charged by the charger 21, and the charged surface thereof is exposed to light in accordance with image information by the exposing device 20 to thereby form an electrostatic latent image thereon. The electrostatic latent image on the photosensitive drum 4 is developed with toners caused to adhere thereto by developing means which is a rotary developing apparatus 9 (9*a*, 9*b*, 9*c*, 9*d*) and is made into visible images, i.e., toner images. The toner images on the photosensitive drum 4 are transferred to an intermediate transfer member 27 by a transfer device 23.

Further, the electrophotographic image forming apparatus 100 according to the present embodiment has the photosensitive drum 4 which is a rotatably supported image bearing member. This photosensitive drum 4 is rotated in the direction indicated by the arrow A in FIG. 1, and is uniformly charged by the primary charger 21 and next, is exposed to an information signal E by the exposing device 20, whereby an electrostatic latent image is formed thereon.

In the present embodiment, the image information signal transmitted from an output device such as an image scanner or a computer (not shown) through an image information processing device is received by the control device (CPU) 28 of the present image forming apparatus. The CPU 28 controls the operation of the image forming apparatus and also, controls a laser beam emitting element 22 constituting the exposing device 20 to thereby cause it to emit a laser beam for electrostatic latent image formation.

For the latent image formation, use can also be made of other types of light emitting members such as a light emitting diode element, besides the laser beam emitting element. Also, the control of the image forming apparatus itself may be effected by another CPU.

According to the present embodiment, the rotary developing apparatus 9 is disposed in opposed relationship with the photosensitive drum 4. The rotary developing apparatus 9 has four developing devices 9*a*, 9*b*, 9*c* and 9*d* in the present embodiment supported in a rotary member 42 journalled for rotation in the direction indicated by the arrow B, and these developing devices are successively opposed to the photosensitive drum 4 to thereby develop the electrostatic latent images of respective colors formed on the photosensitive drum 4, thus forming visible images, i.e., toner images.

The toner images on this photosensitive drum 4 are successively transferred to the intermediate transfer belt 27 as an intermediate transfer member by the primary transfer roller 23 as a primary transferring device, and the toner images of respective colors are superposed one upon another to thereby provide a color image.

In timed relationship therewith, transfer sheets S as recording materials contained in a sheet supplying tray 30 are fed one-by-one by a sheet feeding roller 31, and the transfer sheet is conveyed to a secondary transfer region in which a transfer roller 41 as a secondary transferring device is provided, at predetermined timing. The color image on the intermediate transfer belt 27 is transferred to the conveyed transfer sheet S by the secondary transfer roller 41.

The transfer sheet S to which the toner image has been transferred is conveyed to a fixing device 25 by a conveying portion 32 using a conveying belt or the like, and the transferred toner image is heat-fixed by the fixing device and the transfer sheet is discharged out of the machine.

On the other hand, the surface of the photosensitive drum 4 after the transfer of the toner image is cleaned by a cleaning device 26, and becomes ready for the next image formation.

A description will now be made of a dual-component developing method (magnetic brush developing method) used in the present embodiment.

In magnetic brush development wherein a magnetic ear, i.e., a magnetic brush, is formed on the surface of a developer carrying member, the developer is conveyed to the surface of the developer carrying member, and the developer is held in a brush shape (magnetic ear) and is brought into contact with the image bearing member, and the toner selectively adheres to the surface of the latent image by the electric field between the image bearing member on which the electrostatic latent image has been formed and the developer carrying member to which an electrical bias has been applied, whereby development is effected.

The above-mentioned developer carrying member is usually constituted as a cylindrical sleeve (developing sleeve), and a magnet member (magnet roller) for forming a magnetic field so as to cause the "earring" of the developer on the surface of this developer carrying member is provided in the developing sleeve.

In case of the earring, a carrier ears on the developing sleeve so as to be along a line of magnetic force produced by the magnet roller, and the charged toner adheres to this earring carrier.

The magnet roller has a plurality of magnetic poles, and a magnet forming each magnetic pole is formed into a bar shape or the like, and particularly a developing area portion on the surface of the developing sleeve is provided with a developing main magnetic pole for erecting the developer.

A design is made such that at least one of the developing sleeve and the magnet roller is moved, whereby the developer earring on the surface of the developing sleeve is moved, and the developer conveyed to the developing area causes earring along a line of magnetic force emitted from the above-mentioned developing main magnetic pole to thereby form the chain ear of this developer, which contacts with the surface of the photosensitive drum as a latent image bearing member, and the chain ear of the developer having contacted with the drum effects the supply of the toner while contacting with the electrostatic latent image by the speed difference relative to the photosensitive drum.

It is to be understood that the developing area is a range in which a magnetic ear erects on the developing sleeve and contacts with the photosensitive drum.

A description will now be made in detail of the developing apparatus used in the present embodiment.

In the present embodiment, the rotary developing apparatus 9 is used as the developing apparatus. The four developing devices 9*a*, 9*b*, 9*c* and 9*d* carried on the rotary developing apparatus 9 are similar in construction to one another and therefore, the developing device 9*a* will hereinafter be described with reference to FIG. 2.

Figure 2:
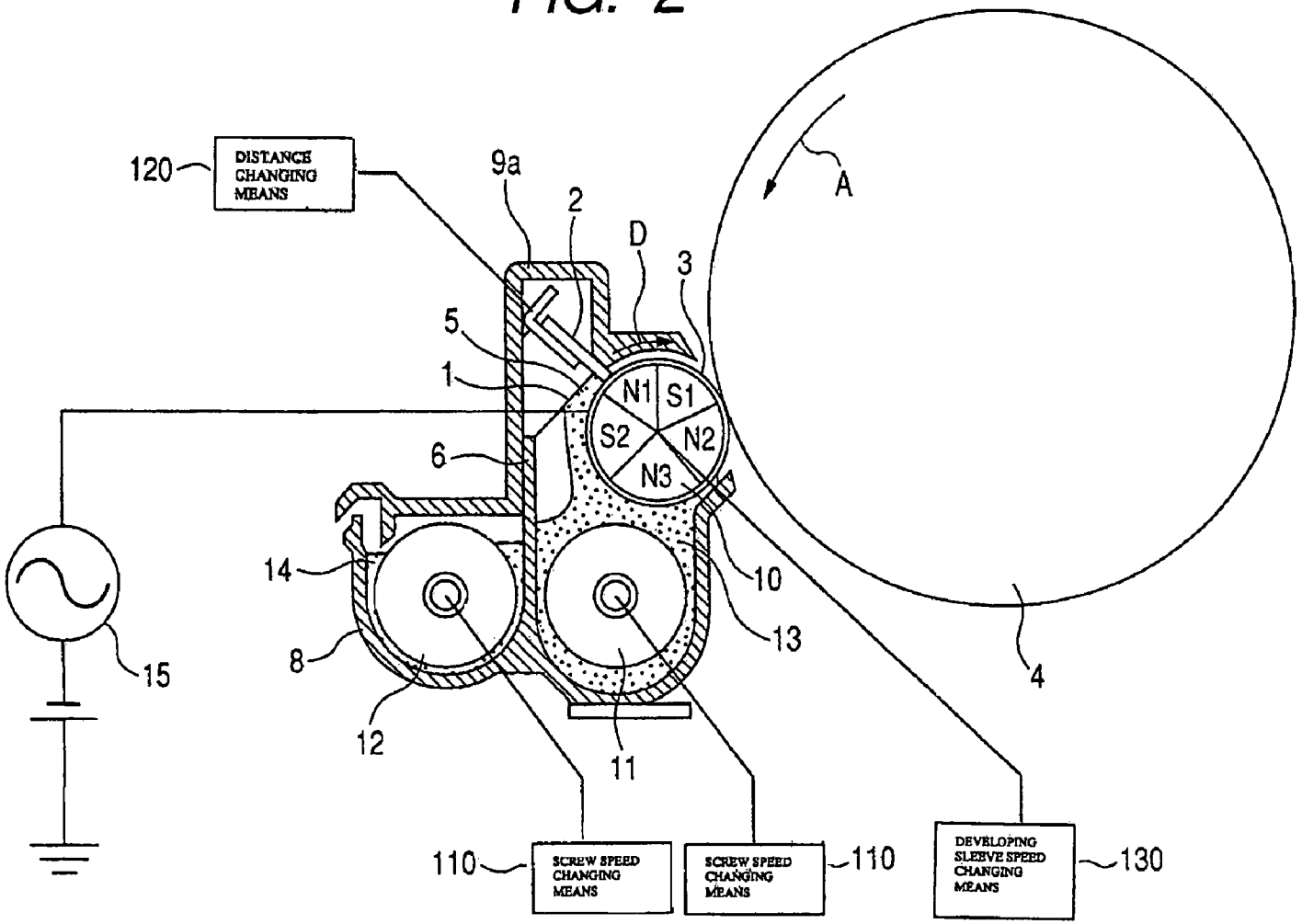
FIG. 2 is a schematic view showing the construction of a developing device.

In FIG. 2, the developing device 9*a* is located at a developing position opposed to the photosensitive drum 4 by a rotary member 42. The developing device 9*a* has a developer container 8, a developing sleeve 3 as a developer carrying member, a developer returning member 1 for regulating a developer reservoir portion 5, and a blade 2 as a developer ear height regulating member.

The interior of the developing device 9*a* is comparted into a developing chamber (first chamber) 13 and an agitating chamber (second chamber) 14 by a partition wall 6 extending in a vertical direction, and communicates with an end portion area (not shown). A dual-component developer including a nonmagnetic toner and a magnetic carrier is contained in the developing chamber 13 and the agitating chamber 14, and is circulated between the developing chamber 13 and the agitating chamber 14. Also, a first agitating screw 11 and a second agitating screw 12 as developer agitating means are disposed in the developing chamber 13 and the agitating chamber 14, respectively.

The developing chamber 13 of the developing device 9*a* opens at a position corresponding to the developing area facing the photosensitive drum 4, and the developing sleeve 3 as the developer carrying member is rotatably disposed in such a manner as to be partly exposed in this opening portion. The developing sleeve 3 is formed of a nonmagnetic material, and is rotated in the clockwise direction indicated by the arrow D during the developing operation, and a magnet (magnet roller) 10 which is magnetic field generating means is fixed in the interior thereof.

The developing sleeve 3 carries and conveys a layer of the dual-component developer having its layer thickness regulated by the blade 2, and supplies the developer to the photosensitive drum 4 in the developing area opposed to the photosensitive drum 4 to thereby develop the latent image. In order to improve developing efficiency, a development bias voltage comprising, for example, a DC voltage and an AC voltage superimposed thereon is applied from a development bias voltage source 15 to the developing sleeve 3.

The magnet roller 10 of such a developing device 9*a* is of e.g. a five-pole construction, and the developer agitated by the agitating screw 11 in the developing chamber is restrained by the magnetic force of a conveying magnetic pole for drawing up (drawing-up pole) N3, and is conveyed to the developer reservoir portion 5 by the rotation of the developing sleeve 3.

The developer amount is regulated by the developer returning member 1, and in order to restrain the stable developer, the developer is sufficiently restrained by a conveying magnetic pole (cut pole) S2 having a predetermined or greater magnetic flux density, and is conveyed while forming a magnetic brush.

Then, the magnetic brush is cut by the blade, i.e., the ear height regulating member 2 to thereby make the developer amount proper, and the developer is conveyed by a conveying magnetic pole N1.

Further, a bias voltage comprising a direct current and/or an alternate electric field superimposed one upon another is applied to the developing sleeve 3 by a developing pole S1 through a developing bias voltage source 15 provided on an image forming apparatus main body side, whereby the toner on the developing sleeve 3 is moved to the electrostatic latent image side on the photosensitive drum 4, and the electrostatic latent image is visualized as a toner image.

Also, near the cut pole S2, the developer comprising two components is rubbed to thereby impart predetermined charges to the toner. The toner is particles of polyester, styrene acryl or the like having a pigment dispersed therein, and is given the charges by the frictional contact thereof with a carrier comprising a magnetic material such as ferrite coated with acryl, silicone resin or the like.

To stably develop the latent image determined to a predetermined potential with constant density, it is necessary for the charges of the toner to be stable, and for that purpose, the developer must be sufficiently restrained and rubbed in the developer reservoir portion 5 near the cut pole S2. Also, the charges given to the toner by this rubbing are determined chiefly by the charge imparting capability of the carrier and the resistance value of the developer.

The toner consumed during development is supplied from a toner supplying tank (not shown). This supply amount is determined by a CPU 28 on the basis of a signal from developer density detecting means (not shown) using optical or electromagnetic means.

The developing device 9*a*, by the afore-described construction, holds the developer supplied to the surface of the developing sleeve 3 by the agitating screws 11 and 12 in the state of a magnetic brush by the magnetic force of the magnet roll 10, and conveys this developer to the opposed portion (developing area) to the photosensitive drum 4 on the basis of the rotation of the developing sleeve 3 and also, cuts the magnetic brush by the developer returning member 1 and the blade 2 to thereby maintain the developer amount conveyed to the developing area proper.

In recent years, a higher quality of image has come to be required in the market of the image forming apparatus. The main qualities of image include density, uneven density, ground fog, particulate state, lateral line reproducibility, trailing edge white streak, dot blank, fog, etc. Above all, the particulate state, the trailing edge white streak, the lateral line reproducibility and the dot blank are items very important to achieve a high quality of image.

Particularly, image noise caused by the toner irregularly adhering to the electrostatic latent image on the image bearing member poses a problem. For example, in a printer and an image forming apparatus or the like of a digital type, in order to reproduce a smooth halftone, the uniform formation of dots formed at intervals of several tens of μm is required. However, when a dot image is enlarged and observed by means of a microscope or the like, the irregularity of the shape or area of the dot is great, and it is observed that the toner irregularly adheres among the dots. When the degrees of these are great, there results an image that is conspicuous in roughness and poor in the sense of uniformity.

A description will now be made of the trailing edge white streak, the lateral line reproducibility and the dot blank.

Figure 3:
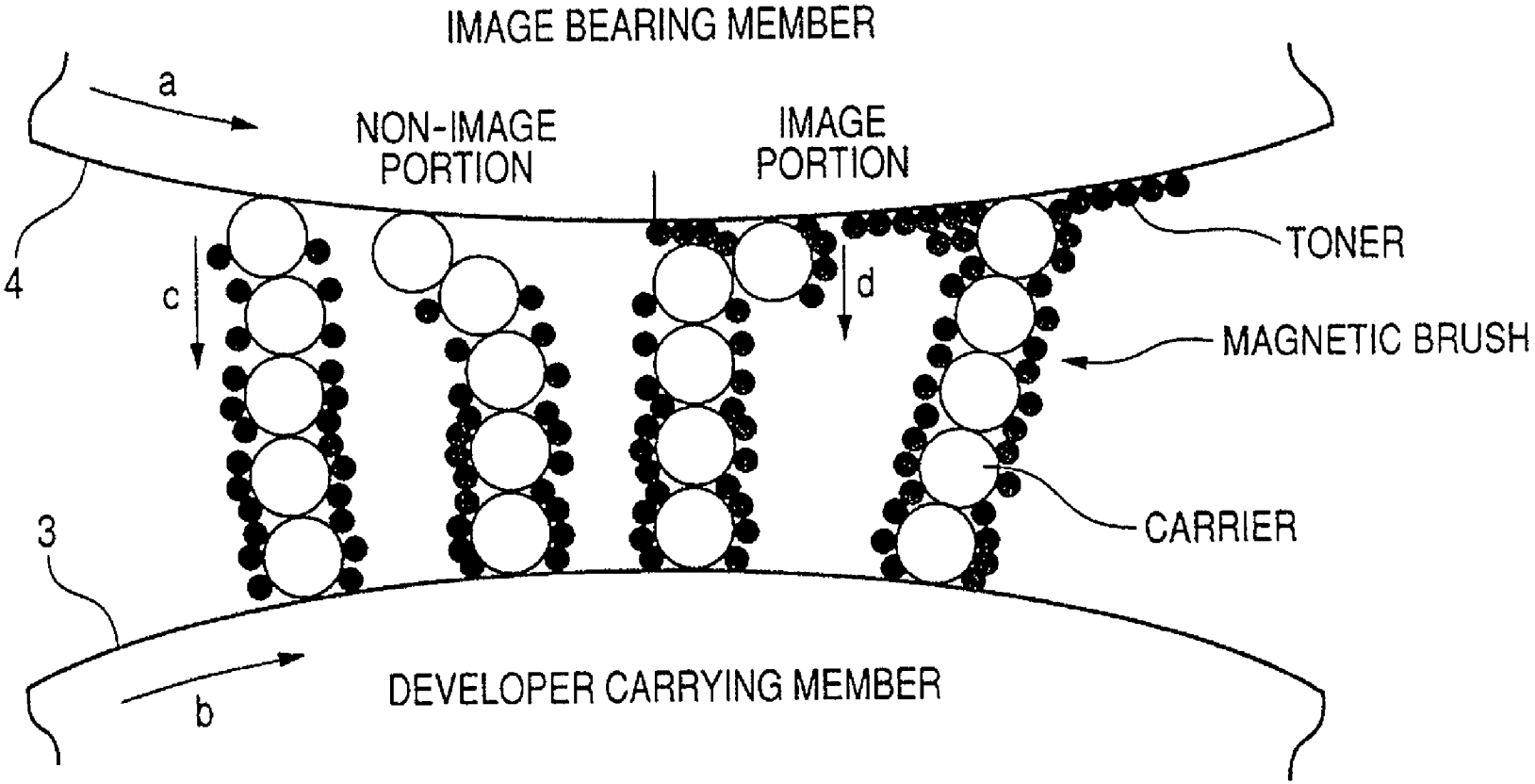
FIG. 3 illustrates the relation between a development gap and an end portion white streak.

FIG. 3 conceptually shows the developing portion for illustrating the cause of the trailing edge white streak. In this figure, it is to be understood that the image bearing member (photosensitive drum 4) and the developer carrying member (developing sleeve 3) are moved (rotated) in the directions indicated by the arrows "a" and "b", respectively. The developing sleeve 3 is greater in the rotating speed in order to increase the developing opportunity as much as possible. Therefore, the magnetic brush develops while always outrunning the electrostatic latent image formed on the photosensitive drum 4.

When the magnetic brush contacts with the non-image portion (ground portion) on the photosensitive drum 4 on the upstream side of the developing area, the toner present on the distal end of the magnetic brush receives a force in the direction toward the developing sleeve 3 (the direction indicated by the arrow "c") due to the influence of an electric field in the developing area and separates from the photosensitive drum 4. Therefore, the longer time during which the magnetic brush contacts with the non-image portion, results in a greater reduction of toner density, near the photosensitive drum 4.

When the magnetic brush is moved to the downstream side of the developing area with the movement of the developing sleeve 3 and catches up with the image portion, the distal end of the magnetic brush which is low in toner density electrostatically attracts the toner already used for development and adhering to the photosensitive drum 4 in the direction indicated by the arrow "d". Therefore, the amount of toner on the trailing edge portion of the image becomes small. On the other hand, the toner density at the distal end of the magnetic brush increases again. Even if the magnetic brush is further moved to the downstream side of the developing area, it will not happen that the toner is attracted from the photosensitive drum 4, because the toner density is recovered. As the result, an image having its trailing edge portion looking blurred is formed on the photosensitive drum 4 having passed the developing area.

The deterioration of the quality of image will now be described. The quality of image is changed by the charger, the developing device, the photosensitive drum, the intermediate transfer member, the fixing device, etc. being deteriorated by endurance testing. Among them, the lifetime of the developer which is the most important factor for deteriorating the quality of image will hereinafter be described.

The deterioration of the developer affects various qualities of images. For example, in the case of a dual-component developing apparatus, it sometimes happens that the coat of the carrier is peeled off by endurance testing and the charge imparting capability to the toner is lowered and the developing capability is lowered and thus, the density of the image is reduced. Also, if an extraneous additive imparted to enhance the chargeability of the toner itself and keep the fluidity thereof enters the interior of the toner, the charging capability will be reduced and further, the irregularity of the chargeability will become great. As the result, it becomes impossible to satisfy the minute dot reproducibility of the image.

Besides, there are various developer deterioration phenomena such as carrier spent in which the toner adheres to the surface of the carrier, the oozing of wax contained in the developer to make the toner easy to fix, and the deterioration of the parent body of the toner.

However, it is difficult to detect the respective deterioration phenomena directly in the image forming apparatus. For example, as regards the carrier spent, it is possible to discriminate a substance adhering to the surface by an electron beam microscope and an elementary analyzer. Also, as regards the peeling-off of the carrier coat, it is possible to detect a rough amount of peeling-off by a fluorescent X-ray. As regards the particle size distribution, the center value and the standard deviation are measured by a Coulter counter method or E-Spart analyzer generally used.

So, in the present embodiment, the deterioration of the developer was not directly detected, but attention was paid to the characteristic values of the developer occurring due to the deterioration. When the developer is deteriorated, the charging amount, the toner amount, the fluidity, the proportion of the toner and the carrier, etc. which are the characteristic values of the developer are changed. Further, when the aforedescribed characteristic values are changed, it affects the quality of image.

That is, it is possible to estimate the deterioration of the developer itself not by directly detecting the deterioration of the developer itself, but by detecting the quality of image.

A description will now be made of the causes of the deterioration of the developer.

There are many causes of the deterioration of the developer. The lifetime of the above-described developer is generally calculated by changes in the characteristic values of the developer and abnormal images during actual endurance testing. However, the degree of each of the changes differs depending on endurance test conditions. Mention may be made, for example, of a duty difference which is the density of an original, the number of sheets passed per day, environmental conditions (temperature and humidity), etc. As the characteristic values of the developer, mention can be made of the charge amount, fluidity, etc. of the developer described above. The parameters of the developer during endurance testing include the charge amounts, the developer amounts, the charge distributions, the particle size distributions, the developing efficiency, the TD ratio, etc. on the developing sleeve 3 and the photosensitive drum 4. These are synthetically judged together with the degree of contamination and the amount of adhering carrier on the developing sleeve 3, the characteristics of the environment when left as it is, the triboelectricity rising characteristic, etc. to thereby calculate the lifetime of the developer.

The lifetime of the developer which affects the quality of image as described above is affected by various conditions. However, it has been found that the quality of each image has some correlations with the characteristic values of the developer.

Table 1 below shows the relations among the characteristic values and physical property values of the developer and the quality of image.

TABLE 1

| | direction toward becoming bad | | | | |
|---|---|---|---|---|---|
| | | Q/M (−15, −30, −45) | | M/S (0.4, 0.55, 0.70) | |
| quality of image | TD ratio (4, 7.5, 10%) | absolute value | standard deviation | absolute value | standard deviation |
| density irregularity | high | low | great | low | great |
| absolute value of density | low | low/high | — | low | — |
| coarseness and particulate property | — | low | great | — | great |
| white streak on trailing edge portion | — | — | — | great | — |
| white spot | large | low | — | — | — |
| line reproducibility dot reproducibility | low/high | low | great | great | great |
| carrier adherence | — | great | great | great | — |
| fog | high | — | great | great | — |

presence of sensitivity: high or low
absence of sensitivity: —

About the dual-component developing apparatus, how the ratio of the toner and the carrier (hereinafter referred to as the "TD ratio"), the charging amount of the toner (hereinafter referred to as the "triboelectricity") and the toner amount (hereinafter referred to as "M/S") affect the image density irregularity, the absolute value of density, the particulate property, the white streak on the trailing edge portion, the white spot, line reproducibility, dot reproducibility, carrier adherence and fog described above will hereinafter be collectively described.

The unit of the quality of each image is classified into the following levels.

That is, the density irregularity is the density difference in A4 of the reflection density measurement by X-Rite. The absolute value of density is likewise the reflection density 5-point mean value by X-Rite. As regards the particulate property, the white streak on the trailing edge portion, the white spot and dot reproducibility, the level thereof was objectively classified into five stages and ranking was carried out. The carrier adherence is the number of carrier particles per unit area. The fog is a fog value (%) found from reflectance.

The developing conditions are as follows.

The peripheral speed of the developing sleeve 3 is 200 mm/sec., the distance between the developing sleeve 3 and the photosensitive drum 4 (hereinafter referred to as the "developing gap") is 500 μm, the gap between the developing sleeve 3 and the blade 2 (hereinafter referred to as the "SB gap") is 600 μm, the development bias AC voltage is 2000 V, the frequency is 8 kHz, the dark potential is −600 V, the light potential is −50 V, the developer agitating speed of the agitating screws 11 and 12 is 350 rpm, and the development bias DC component is −450 V. Also, the peripheral speed of the photosensitive drum 4 is 160 mm/sec., the diameter of the developing sleeve 3 is 25 mm, and the diameter of the photosensitive drum is 84 mm. Also, the initial values of the characteristic values of the developer are the TD ratio 7.5%, the triboelectricity 30 μC/g, M/S 0.55 mg/cm$^2$, the toner mean particle diameter 7.5 μm and the carrier mean particle diameter 35 μm.

A description will hereinafter be made of the relations between the characteristic values and the developing characteristic of the developer.

(Triboelectricity)

First, the triboelectricity was forcibly lowered from −35 μC/g as the center value to −15 μC/g. As the result, the triboelectricity distribution irregularity on the developing sleeve 3 affected and therefore, influence was given to density irregularity. Also, generally the charge amount is small and therefore, the toner which can fly to the photosensitive drum decreased and the absolute value of density was also lowered. The particulate property became bad by the triboelectricity being lowered. Besides, it has been found from an experiment that the white spot, the line reproducibility and the dot reproducibility are affected.

Conversely, what would result when the center value of the triboelectricity was raised to −45 μC/g was verified. As the result, image density irregularity occurred. This is because by the center value of the triboelectricity rising, the toner having optimum triboelectricity which could develop was decreased, and the irregular triboelectricity of the toner affected remarkably. Furthermore, it has been found that the carrier adherence to the photosensitive drum was increased.

Also, the distribution of the triboelectricity, i.e., the standard deviation, was changed to thereby examine to what degree it affected the image.

It has been found that when the deviation is great, that is, there are toners having various kinds of triboelectricity, the density irregularity, the particulate property, the line reproducibility, the dot reproducibility, the carrier adherence and the fog are affected. The cause is that the presence or absence of the developer of triboelectricity affecting the image affected.

(M/S)

Next, the toner amount on the developing sleeve 3, i.e., M/S, was changed from 0.55 mg/cm$^2$ which is the center value to 0.4 mg/cm$^2$ at first. The other conditions are all the same. How the conditions were prepared will be described later.

As the result, the density irregularity was aggravated, and the toner amount was lowered and therefore the absolute value of density was lowered. Conversely, when M/S was raised to 0.7 mg/cm$^2$, it has been found that the streak on the trailing edge portion, the line reproducibility, the carrier adherence and the fog were aggravated.

That is, by the toner amount being increased, the latent image is disturbed and the excess toner adheres to a place not scheduled, i.e., a solid white portion and therefore, such image faults occur.

Next, an attempt was made to change the irregularity of M/S on the developing sleeve 3. As the result, the qualities of image great in influence are the density irregularity, the particulate property and the dot reproducibility. The irregulari tyof M/S is because when the level difference of the latent image is small, the influence becomes great.

(TD Ratio)

Next, the TD ratio which is the proportion of the toner and the carrier was decreased from 7.5% which is the center value to 4% at first. As the result, the toner amount on the developing sleeve 3 was lowered and therefore the absolute value of density was lowered and besides, the toner was not sufficiently supplied to the small dot latent image and therefore, the dot reproducibility was aggravated. Conversely, when the TD ratio was raised to 10%, density irregularity occurred under the influence of the irregularity of M/S on the developing sleeve 3, and the white spot due to the excess supply of the toner and likewise, the dot reproducibility were aggravated, and the fog was aggravated because the toner was supplied to the solid image white portion.

Thus, it is seen that the characteristic values of the developer change to thereby affect the image. That is, it can be said that the deterioration of the developer can be indirectly judged from the characteristic values of the developer.

A description will now be made as to how to reproduce the deteriorated state.

Broadly classifying, there are two kinds of methods. One is a method of actually deteriorating the developer, detecting the quality of image under the existing developing conditions, and confirming the latitude. The other is a method of enhancing the sensitivity of the existing state of the developer by other method without deteriorating the developer, and making it reach a level which can be detected by the quality of image. These two methods will now be described.

Table 2 below shows the relations (i.e., the sensitivity) between a method of deteriorating a representative developer (i.e., each development parameter) and the quality of image.

TABLE 2

| parameter direction | VD characteristic | | peripheral speed ratio | | development gap | | SB gap | | Vpp | | frequency | |
|---|---|---|---|---|---|---|---|---|---|---|---|---|
| quality of image | small | great | small | great | small | great | small | great | small | great | small | great |
| density irregularity | ¤ | | ○ | | ○ | ○ | ○ | — | ○ | — | Δ | Δ |
| absolute value of density | ¤ | — | ○ | — | Δ | ○ | ○ | — | ○ | — | Δ | Δ |
| coarseness, particulate property | Δ | — | — | ○ | — | ○ | ○ | ○ | ○ | — | Δ | |
| white streak on trailing edge | — | — | — | ¤ | ○ | — | — | ○ | — | Δ | — | — |
| white spot | — | Δ | Δ | — | — | ○ | ○ | — | — | Δ | Δ | — |
| line reproducibility | ○ | ○ | Δ | Δ | ○ | — | ○ | — | ○ | — | Δ | — |
| dot reproducibility | | | | | | | | | | | | |
| carrier adherence | ○ | — | — | — | ○ | — | — | ○ | — | ○ | | ○ |
| fog | ¤ | ¤ | — | Δ | Δ | — | — | Δ | — | ¤ | ○ | |

| parameter direction | toner supply amount | | environment moisture amount | | agitating speed | |
|---|---|---|---|---|---|---|
| quality of image | no supply | continuous supply | small | great | small | great |
| density irregularity | | ○ | | ○ | Δ | ○ |
| absolute value of density | ○ | | ○ | | Δ | ○ |
| coarseness, particulate property | ○ | Δ | | ○ | Δ | ○ |
| white streak on trailing edge | — | — | — | — | — | Δ |
| white spot | — | ○ | ○ | — | Δ | |
| line reproducibility | | ○ | — | ○ | Δ | Δ |
| dot reproducibility | | | | | | |
| carrier adherence | — | — | ○ | — | — | — |
| fog | — | ○ | ○ | — | Δ | ○ |

sensitivity great ¤,
medium ○,
small Δ,
null —

There are several methods of deteriorating the developer. They are, for example, the agitating speed of the developing device, the environment moisture amount in which the image forming apparatus is installed, the supply amount of the toner, the forcible supply of the extraneous additive, the sheet passage study by a low image proportion, etc.

(Agitating Speed)

When the agitating speed of the developing device by the first and second agitating screws 11 and 12 are reduced from the existing 350 rpm to 60 rpm, the rising of the triboelectricity becomes bad and therefore, the density irregularity and the absolute value of density become bad. Also, the triboelectricity on the developing sleeve 3 becomes non-uniform and therefore, a white spot and the lack of dots occur. When the agitating speed is raised to 1,000 rpm, it directly affects the deterioration of the developer. First, the carrier coat is peeled by the agitation, the toner adheres to the carrier, and the extraneous additive of the toner separates, and the triboelectricity is lowered and the size distribution of toner is broadened.

As the result, as described above, the density irregularity, the absolute value of density, the particulate property and the fog are greatly affected. Also, the drawing force by the deterioration of the developer is reduced, and the white spot is aggravated, and the dot reproducibility is also aggravated, though more or less.

(Environment Moisture Amount)

When the environment moisture amount was lowered from 10 gram/m3 which is a mean value to 1 milligram/m3, Q/M rose sharply and the absolute value of density lowered. Also, the edge effect was emphasized and the white spot was aggravated, and a reversed component increased, and the carrier adherence was also aggravated and the fog of the reversed component also increased.

On the other hand, when the moisture amount was raised to 21 g/m$^3$, the degree of condensation was changed, whereby the irregularity of the triboelectricity and M/S was increased and the density irregularity was aggravated, and the distribution of the triboelectricity became non-uniform and the particulate property was aggravated, and the dot reproducibility shifted in a bad direction.

(Toner Supply Amount)

Next, about the toner supply amount, an attempt was made to change the TD ratio. First, when sheets were continuously passed without supply, the triboelectricity rose and the absolute value of density lowered. Also, the particle size was increased by selective development, and the particulate property was aggravated. Also, when a greater amount of toner than the consumed amount was supplied by continuous supply, triboelectricity irregularity occurred, and density irregularity and the particulate property were aggravated and particularly, the dot reproducibility was aggravated. As regards the fog, ground fog occurred.

As described above, it has been found that the developer itself is deteriorated, whereby the conventional quality of image is aggravated.

However, when in actual use, the developer was deteriorated by the above-described means, it is very difficult to recycle it. When the toner density of the developer is to be lowered, the toner must be consumed, and conversely, to increase the toner amount, the toner must be supplied. In this case, there is the possibility that the charge amount of the developer may fluctuate.

Therefore, a method of replacing the developer is most desirable. However, it is generally known that considerable irregularity occurs to the developer depending on the manufacturing condition thereof. There have been reported a number of cases where when the developer is replaced at an interval of a half year or a year, there occurs a difference between the upper and lower limits of the manufacturing condition and the lifetime of the developer eily lasts shorter than expected. Accordingly, to a user using a great number of sheets per day, or a user who will have trouble if the apparatus is stopped for a long period, it is very important to grasp the latitude of the developer used beforehand.

The developer deterioration latitude is investigated by the deteriorating means in the present embodiment, and the developer is replaced immediately before its lifetime is reached, whereby it becomes possible to improve the rate of operation.

Table 3 below shows the relation (experimental result) between each development parameter and the quality of image. That is, in Table 3, there are described the maintenance property and reproducibility of each method, and the costs required for control. It will be seen that the deteriorating method is generally bad in the maintenance property. However, the effect of knowing the irregularity of the material at the beginning is the greatest.

TABLE 3

| | | sensitivity up method by developing conditions | | | | | | | | | | | |
|---|---|---|---|---|---|---|---|---|---|---|---|---|---|
| parameter direction quality of | method center value upper and | VD characteristic: −600 V | | peripheral speed ratio: 125% | | development gap: 500 μm | | SB gap: 600 μm | | Vpp: 2000 V | | frequency: 8 kHz | |
| image | lower limits | 0 V | −800 V | 80% | 200% | 250 μm | 750 μm | 300 μm | 1000 μm | 500 V | 3000 V | 4 kHz | 12 kHz |
| density irregularity | reflection density irregularity is great (Δ→) | 0.4 | | 0.3 | | 0.32 | 0.31 | 0.33 | — | 0.26 | — | 0.15 | 0.05 |
| absolute value of density | reflection density lowered (1.4→) | 1 | — | 1.2 | — | 1.35 | 1.36 | 1.29 | — | 1.25 | — | 1.39 | 1.35 |
| coarseness, particulate property | level aggravated (1→5) | 3 | — | — | 4 | — | 4 | 3 | 3 | 4 | — | 2 | |
| white streak on trailing edge | level aggravated (1→5) | — | — | — | 5 | 4 | — | — | 4 | — | 2 | — | — |
| white spot | level aggravated (1→5) | — | 2 | 2 | — | — | 4 | 4 | — | — | 2 | 2 | — |
| line reproducibility dot reproducibility | level aggravated (1→5) | 3 | 4 | 2 | 2 | 3 | — | 3 | — | 3 | — | 2 | — |
| carrier adherence | number of particles increased | 3 | — | — | — | 4 | — | — | 5 | — | 3 | | 3 |
| fog | % increased | 10 | 12 | — | 2 | 2 | — | — | 2 | — | 9 | 5 | |
| maintenance | working time (rank 1→5) | 1 | | 1 | | 1 | | 1 | | 1 | | 1 | |
| | reproducibility (rank 1→5) | 2 | | 2 | | 1 | | 2 | | 1 | | 1 | |

TABLE 3-continued

| | | | | | | | | | |
|---|---|---|---|---|---|---|---|---|---|
| cost and time required for control (rank 1→5) | | | 2 | 2 | 2 | 5 | 2 | 2 | |
| | parameter | method | developer deteriorating method | | | | | | |
| | direction quality of | center value upper and | toner supply amount | | environment moisture amount: 10 g/m$^3$ | | agitating speed (350 rpm) | | |
| | image | lower limits | no supply | continuous supply | 1 g | 21 g | 60 rpm | 1000 rpm | Ref |
| | density irregularity | reflection density irregularity is great (Δ→) | | 0.35 | | 0.38 | 0.2 | 0.37 | 0.12 |
| | absolute value of density | reflection density lowered (1.4→) | 1.3 | | 1.34 | | 1.39 | 1.2 | 1.39 |
| | coarseness, particulate property | level aggravated (1→5) | 4 | 2 | | 3 | 2 | 4 | 2 |
| | white streak on trailing edge | level aggravated (1→5) | — | — | — | — | — | 2 | 2 |
| | white spot | level aggravated (1→5) | — | 3 | 3 | — | 2 | | 2 |
| | line reproducibility dot reproducibility | level aggravated (1→5) | | 3 | — | 4 | 2 | 2 | 2 |
| | carrier adherence | number of particles increased | — | — | 4 | — | — | | 2 |
| | fog | % increased | — | 6 | 7 | — | 2 | 5 | 3 |
| | maintenance | working time (rank 1→5) | 5 | | 5 | | 5 | | — |
| | | reproducibility (rank 1→5) | 2 | | 2 | | 2 | | — |
| | cost and time required for control (rank 1→5) | | 2 | | 2 | | 2 | | — |

level (rank)
1: good
↕
5: bad

A description will now be made of a method of not expediting the deterioration of the developer itself, but increasing the sensitivity of the irregularity of the developer under other developing conditions to thereby detect the quality of image.

As representative methods, mention may be made of the developing characteristic changing the DC component of the development bias, the peripheral speed of the developing sleeve 3, the development gap, the SB gap, the peak potential of the AC component of the development bias, the frequency of the AC component of the development bias, etc.

Table 4 below shows the relation (effect) between each development parameter and the quality of image. The other developing conditions and the center value are the same as those in the foregoing examples.

TABLE 4

| | | Sensitivity (change relative to Ref) | | | | | | | | | | | |
|---|---|---|---|---|---|---|---|---|---|---|---|---|---|
| | | sensitivity up method by developing conditions | | | | | | | | | | | |
| parameter direction quality of | method center value upper and | VD characteristic: −600 V | | peripheral speed ratio: 125% | | development gap: 500 μm | | SB gap: 600 μm | | Vpp: 2000 V | | frequency: 8 kHz | |
| image | lower limits | 0 V | −800 V | 80% | 200% | 250 μm | 750 μm | 300 μm | 1000 μm | 500 V | 3000 V | 4 kHz | 12 kHz |
| density irregularity | reflection density irregularity is great(Δ→) | 3.3 | 0.0 | 2.5 | 0.0 | 2.7 | 2.6 | 2.8 | | 2.2 | | 1.3 | 0.4 |
| absolute value of density | reflection density lowered (1.4→) | 0.7 | | 0.9 | | 1.0 | 1.0 | 0.9 | | 0.9 | | 1.0 | 1.0 |
| coarseness, particulate property | level aggravated (1→5) | 1.5 | | | 2.0 | | 2.0 | 1.5 | 1.5 | 2.0 | | 1.0 | 0.0 |
| white streak on trailing edge | level aggravated (1→5) | | | | 2.5 | 2.0 | | | 2.0 | | 1.0 | | |

TABLE 4-continued

| | | | | | | | | | | | | | |
|---|---|---|---|---|---|---|---|---|---|---|---|---|---|
| Sensitivity (change relative to Ref) | | | | | | | | | | | | | |
| white spot | level aggravated (1→5) | | 1.0 | 1.0 | | | 2.0 | 2.0 | | | 1.0 | 1.0 | |
| line reproducibility dot reproducibility | level aggravated (1→5) | 1.5 | 2.0 | 1.0 | 1.0 | 1.5 | | 1.5 | | 1.5 | | 1.0 | |
| carrier adherence | number of particles increased | 1.5 | | | | 2.0 | | | 2.5 | | 1.5 | 0.0 | 1.5 |
| fog | % increased | 3.3 | 4.0 | | 0.7 | 0.7 | | | 0.7 | | 3.0 | 1.7 | 0.0 |
| maintenance | working time (rank 1→5) | 1.0 | | 1.0 | | 1.0 | | 1.0 | | 1.0 | | 1.0 | |
| | reproducibility (rank 1→5) | 2.0 | | 2.0 | | 1.0 | | 2.0 | | 1.0 | | 1.0 | |
| cost and time required for control (rank 1→5) | | 2.0 | | 2.0 | | 2.0 | | 5.0 | | 2.0 | | 2.0 | |

| parameter | method | developer deteriorating method | | | | | | |
|---|---|---|---|---|---|---|---|---|
| direction quality of | center value upper and | toner supply amount | | environment moisture amount: 10 g/m$^3$ | | agitating speed. (350 rpm) | | |
| image | lower limits | no supply | continuous supply | 1 g | 21 g | 60 rpm | 1000 rpm | Ref |
| density irregularity | reflection density irregularity is great(Δ→) | 0.0 | 2.9 | 0.0 | 3.2 | 1.7 | 3.1 | 0.12 |
| absolute value of density | reflection density lowered (1.4→) | 0.9 | 0.0 | 1.0 | 0.0 | 1.0 | 0.9 | 1.39 |
| coarseness, particulate property | level aggravated (1→5) | 2.0 | 1.0 | 0.0 | 1.5 | 1.0 | 2.0 | 2 |
| white streak on trailing edge | level aggravated (1→5) | | | | | | 1.0 | 2 |
| white spot | level aggravated (1→5) | | 1.5 | 1.5 | | 1.0 | 0.0 | 2 |
| line reproducibility dot reproducibility | level aggravated (1→5) | 0.0 | 1.5 | | 2.0 | 1.0 | 1.0 | 2 |
| carrier adherence | number of particles increased | | | 2.0 | | | | 2 |
| fog | % increased | | 2.0 | 2.3 | | 0.7 | 1.7 | 3 |
| maintenance | working time (rank 1→5) | 5.0 | | 5.0 | | 5.0 | | 1 |
| | reproducibility (rank 1→5) | 2.0 | | 2.0 | | 2.0 | | 1 |
| cost and time required for control (rank 1→5) | | 2.0 | | 2.0 | | 2.0 | | 1 |

(To Ref: amount of change after 10 k endurance test sheets)
level (rank)
1: good
↕
5: bad (Developing Characteristic)

The developing characteristic is determined by the electric field intensity of the developing sleeve 3 and the photosensitive drum 4, the triboelectricity on the developing sleeve 3 and M/S. That is, to make the deterioration of the developer remarkable, it is necessary to choose a condition under which the influence of the triboelectricity and M/S becomes greatest. Particularly, in the developing characteristic, the irregularity of triboelectricity distribution and M/S is liable to occur in a low contrast portion. That is, when $V_{DC}$ is lowered from −450 V which is the center value to 0 V, the toner flying to the photosensitive drum is limited and therefore, it becomes easy to pick up the irregularity of the triboelectricity and M/S and the absolute value of density is very much lowered. Also, the dot reproducibility, particularly the halftone affects. Also, when there is a toner of a reversed component, it flies to the photosensitive drum and therefore, it becomes easy to detect. Conversely, when $V_{DC}$ is raised to −800 V to thereby heighten the contrast, the collapse of lines and dots by the too much bearing of the toner occurs. When the developer is deteriorated and the triboelectricity is low, the bearing amount may sometimes further increase.

(Peripheral Speed of the Developer Carrying Member)

The peripheral speed of the developing sleeve 3 will now be described. The peripheral speed of the developing sleeve 3 is generally made higher than the peripheral speed of the photosensitive drum 4 because the development nip is increased to thereby provide a high quality of image. In the present embodiment, the center value is 1.25 times as high, and is 200 mm/s in terms of the peripheral speed. Incidentally, the speed of the photosensitive drum 4 is 160 mm/s.

When the peripheral speed is lowered, the substantial development nip and the contact area of the developing sleeve 3 with the unit area of the photosensitive member are reduced.

Thereupon, the M/S irregularity on the developing sleeve 3 occurs remarkably, and the density irregularity and Q/M are reduced and therefore, the absolute value of density is reduced, and although low in contribution rate, the white spot and the dot reproducibility are reduced.

Conversely, when the speed is raised to 200%, the development nip is increased and also, the opportunity of contact with the photosensitive drum 4 is simply decreased and therefore, drawing is not sufficiently done. As the result, the particulate property is aggravated, and the time for which the latent image on the photosensitive drum is disturbed increases and therefore, the white streak on the trailing edge portion is aggravated. Also, although small in influence, the line reproducibility by the thickening of the line was reduced, and an increase in the fog to the white ground portion due to an increase in the developing opportunity occurred.

However, in a method of making the rotating speed of the developing sleeve 3 low, if the driving of the developing sleeve 3 and the agitation driving are the same, when the rotating speed of the developing sleeve 3 is lowered, the agitating speed is lowered and the charge imparting force is decreased, and there is the fear that in the detection of the optimum condition and the latitude, the state of the developer on the developing sleeve 3 may change.

By changing the peripheral speed of the developing sleeve 3 as described above, it is possible to indirectly grasp the degree of deterioration of the developer. That is, by the deterioration of the developer, the triboelectricity is reduced, and the distribution thereof changes to the broad and the irregularity of M/S increases. In this state, the development nip is increased or decreased, whereby the sensitivity of the aforementioned characteristic values is increased.

(Developing Gap)

When the development gap is made small, the distance between the magnetic brush on the developing sleeve 3 and the photosensitive drum 4 becomes small, and there occurs a case where the two contact with each other. That is, the developer collecting effect by the proximity works and affects the density irregularity. Also, the latent image on the drum is scraped off and therefore, the white streak on the trailing edge portion occurs. Also, in the dot reproducibility, it has been confirmed that the phenomenon that isolated dots break off occurs and the carrier adherence also increases. Conversely, when the gap is widened, the density irregularity due to a decrease in developing opportunity is increased, and there occurred a reduction in the absolute value of density due to a reduction in electric field intensity, the aggravation of the particulate property and white spot due to edge enhancement, etc. The latitude of the development gap will be described later in detail.

(SB Gap)

When the gap between the developing sleeve 3 and the blade 2 is made small, the M/S irregularity becomes remarkable. That is, when the developer becomes deteriorated and the M/S irregularity on the developing sleeve 3 is increased, the sensitivity is more increased. It has been found that when the SB gap is made small, the density irregularity, the absolute value of density, the particulate property, the white spot, the dot reproducibility, etc. are aggravated. Also, when the SB gap is increased, the effect of earring affects and therefore, the particulate property and the white streak on the trailing edge portion were aggravated. This appears remarkably when the developer becomes deteriorated, and particularly when the earring density and distribution are changed by the deterioration of the carrier.

On the other hand, in a method of narrowing the developing blade gap, the developing sleeve 3 and the blade 2 bear magnetism and therefore, to provide a mechanism for making the gap variable, the possibility of requiring a high cost as compared with the conventional methods is high.

(AC Peak Voltage of the Development Bias)

The peak value of the AC voltage of the development bias was decreased from the current 2000 V to 500 V. As the result, the low contrast and the intensity of the electric field are lowered, and this affects both of the irregularity of M/S and the irregularity of the triboelectricity. In the quality of image, this affects the density irregularity, the absolute value of density, the particulate property, the dot reproducibility, etc. On the other hand, when the peak voltage is made as high as 3000 V, the carrier which is the reversed component adheres and the texture fog increases. The sensitivity is low, but the toner collecting capability is increased and therefore, the white streak on the trailing edge portion is aggravated, and the white spot greatly affected by the limit value of the carrier charging amount also tends to become bad.

(Frequency)

Next, the frequency of the AC component of the development bias was changed from the current 8 kHz to 4 kHz and 12 kHz.

First, when the frequency is lowered, the separating force of the toner from the developer is reduced and therefore, the absolute value of density is reduced and the particulate property is aggravated. The contribution rate is low, but the white spot and the dot reproducibility also become bad. Also, when the frequency is raised, the separation from the developer becomes good and conversely, the irregularity of M/S and Q/M appears remarkably. As the result, the contribution rate is not high as compared with the other parameters, but yet the density irregularity and the absolute value of density are lowered.

A description of the consequences of lowering the frequency will be made in greater detail.

When the frequency is lowered, the span of the movement of the toner becomes long, and there arises the problem that the toner adheres to the texture portion of the photosensitive drum 4. Further, the reaction of the carrier to a vibration electric field becomes great and the carrier begins its movement, and the state in which the carrier has adhered to the image surface and the action of moving the toner adhering onto the photosensitive drum 4 to thereby lower the quality of image become conspicuous.

On the other hand, the frequency can expedite the separation from the developer by being increased, to thereby increase the toner amount on the photosensitive drum 4, but when it becomes high to a certain degree, it brings about a contrary effect. The mechanism of this will now be described.

In the dual-component developing method, the toner adheres to the carrier by an electrostatic adhering force. When an AC bias is applied, the restraint of the toner against the carrier is released and it becomes easy for the toner to move by an electric field applied to between the developing sleeve 3 and the photosensitive drum 4.

However, the frequency of the vibration bias rises and the time during which it continuously acts on the toner in a particular direction, i.e., the vibration electric field has a phase for moving the toner to the electrostatic latent image and a phase for moving the toner to the developing sleeve 3 and therefore, when the time during which the electric field continuously acts on the toner in the particular direction becomes short, the toner becomes incapable of separating from the carrier, and the effect of raising the density becomes small.

Even if the frequency is increased or decreased, the toner amount on the photosensitive drum 4 will become unstable and therefore, when the latitude is to be actually measured, it is necessary to look in both directions because there exists an inflection point.

As described above, it could be confirmed that means for heightening the sensitivity of the fluctuation of the triboelectricity and the fluctuation of M/S caused by the deterioration of the developer can be reproduced by various developing methods.

On the other hand, other eAts problems are caused by the increase in sensitivity by the above-described means. For example, when the carrier adherence is increased, faulty cleaning occurs, and the leak of the toner is caused by an increase in the AC peak voltage of the development bias or an increase in the development gap, and a hole may be formed on the photosensitive drum to thereby affect the image thereon. Therefore, in the above-described means, it is desirable to set the developing conditions within a range which affects little the other qualities. There is, for example, a method of setting the AC peak potential of the development bias to within 3 kV, or setting the developing gap to 200 μm or greater.

By the above-described two kinds of methods, the relations with the quality of image, the deterioration of the developer, the characteristic values of the developer and the developing conditions have become distinct.

A description will now be made of a method of estimating the lifetime of the developer, and particularly the development efficiency and the edge effect by the use of the development gap.

The development efficiency shows the toner amount adhering to the photosensitive drum 4 when the development contrast which is the difference between the latent image potential on the photosensitive drum 4 and the development bias potential is constant. There exists a development gap G for which the development efficiency becomes maximum. Although depending on the charge amount, the kind and amount of the developer on the developing sleeve 3, the toner amount on the photosensitive drum 4 decreases, that is, the development efficiency lowers as the development gap departs from the gap for which the development efficiency becomes maximum. Accordingly, by changing the development gap G, it is possible to control the toner amount on the photosensitive drum 4.

On the other hand, the development efficiency changes in accordance with the deteriorated state of the developer or the photosensitive drum 4.

Figure 4:
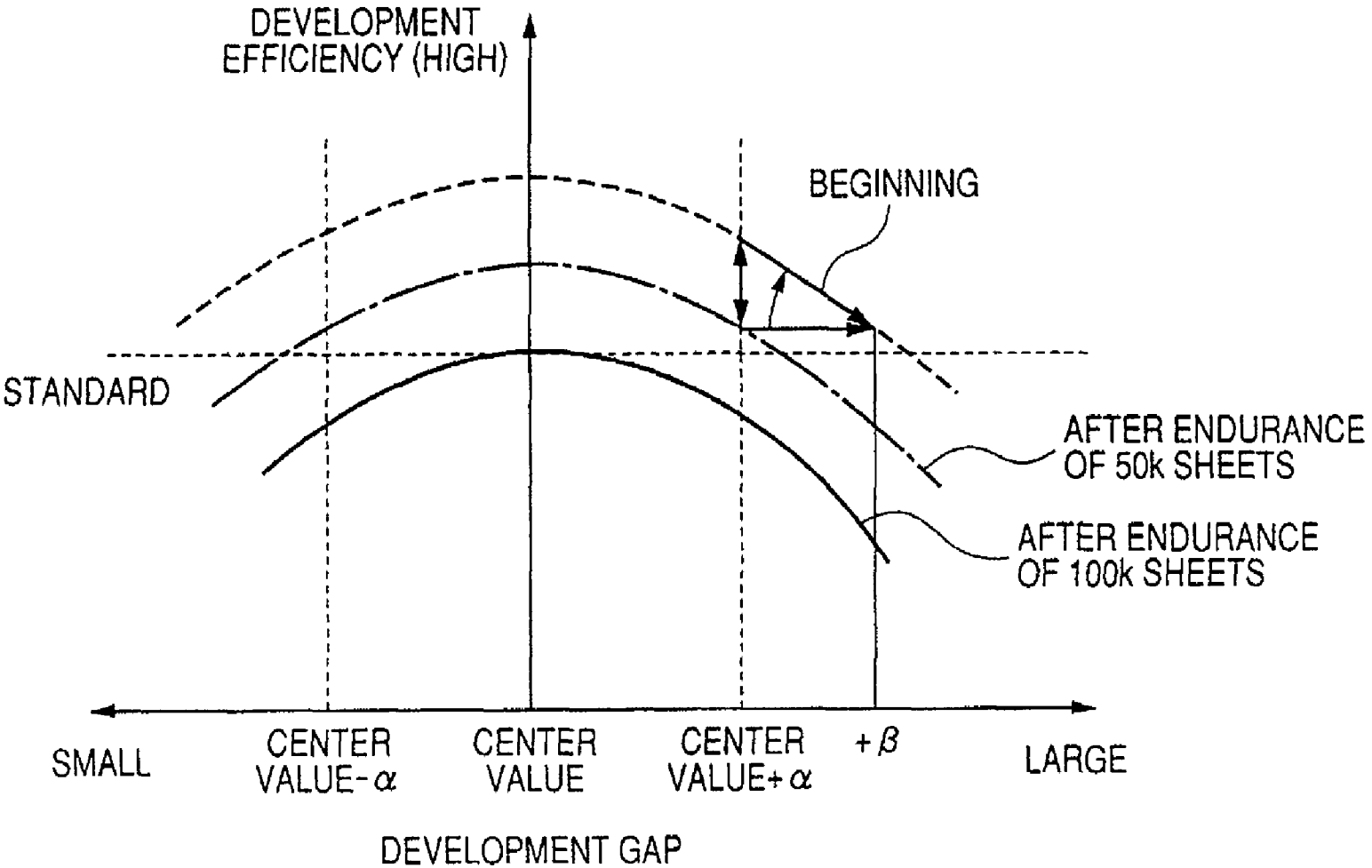
FIG. 4 is a graph showing the relation between the development gap and developing efficiency.

FIG. 4 is a graph in which the development efficiency according to the user's use condition was measured at the beginning and after the endurance test of sheet passing. The development gap G is changed by the order of ±α from the center value to thereby measure the development efficiency, i.e., the toner amount on the photosensitive drum 4.

According to the result of the measurement, it can be seen that the latitude (the area above the standard) of the development efficiency after the endurance test (b, c) has narrowed, as compared with the beginning.

However, in the development gap G (center value) set at the beginning, the development efficiency is satisfied still after the endurance test. That is, even if the developer is deteriorated, the development efficiency is satisfied both at the beginning and after the endurance test and therefore, the user or the serviceman does not become aware of the deterioration. As the result, the end of developer lifetime is reached before the deterioration of the developer is known and therefore, much time is required for the replacement of the developer, and the possibility of the rate of operation being lowered is high. When the development gap G is small, the development efficiency is lowered by the white spot of a solid image portion caused by the leak phenomenon between the surface of the latent image and the developer carrying member.

In the foregoing development gap method, the development gap G was changed from the center value +α to β in the initial state, and the development efficiency was measured. As the result, the amount of change in the development efficiency relative to the gap G is calculated and therefore, the timing in which the developer reaches its lifetime can be distinctly estimated beforehand.

Figure 5:
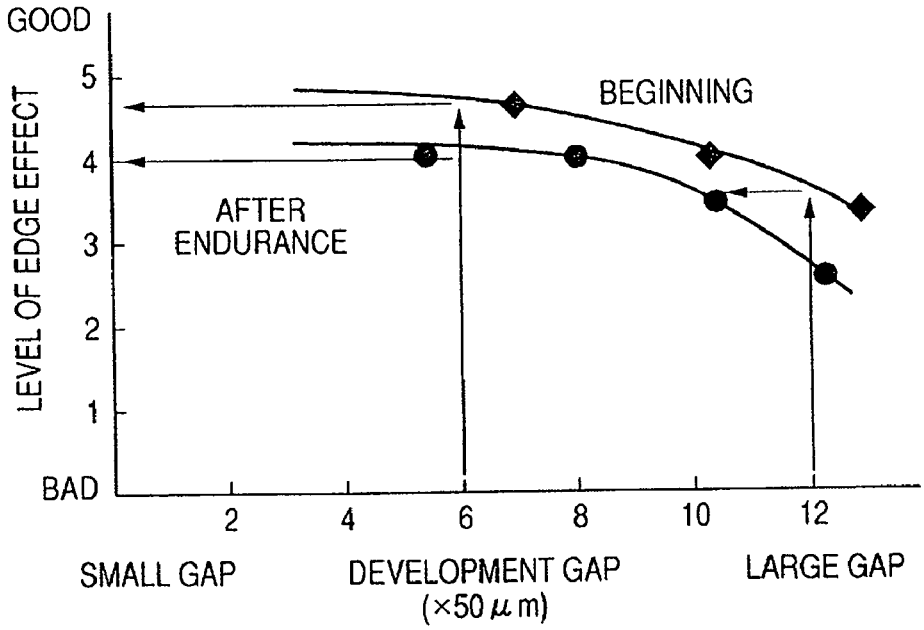
FIG. 5 is a graph showing the relation between the development gap and an edge effect.

FIG. 5 is a graph showing the relation between the development gap G and the edge effect. The axis of the abscissa represents the development gap G and becomes greater toward the right. One unit is 50 μm. The axis of the ordinate represents levels obtained by sensorily evaluating the edge effect. A good level at which the edge effect is not perceived is defined as a rank 5, a bad level at which the edge effect is strongest is defined as a rank 1, and the intermediate levels are defined as ranks 2 to 4 in accordance with the degree thereof.

The influence of the state of the developer is great and therefore, at this time, use was made of the developer at the beginning and the developer after the endurance test of 50 k sheets. It can be seen that in any of these cases, the edge effect becomes strong for 500 μm (10 on the scale) or greater. Also, even if the development gap G is near due to the endurance test the edge effect becomes bad (the edge effect level 4 or lower). The cause is that the developing property was reduced by the deterioration of the developer on the developing sleeve 3 after the endurance test of sheet passing.

Also, in the initial state, the development gap value which is the center value is increased from 300 μm to 600 μm, whereby the edge effect level is lowered from 5 to a little less than 4. After the endurance test of 50 k sheets passing, at 300 μm, the edge effect is at the order of level 4 and therefore, by making the development gap G large in the initial state, it is possible to grasp the latitude of the edge effect of the developer beforehand.

Although not shown in the present embodiment, the edge effect level is aggravated substantially in proportion to the number of sheets passed in the endurance test. Also, in a case which is not in a proportional relation, change transition data is preserved in a storage device, and is compared with the result of the measurement by an arithmetic processing unit, whereby the latitude can be grasped.

On the other hand, when the development gap G is small, there arises the problem that the degree of freedom of the movement of the carrier becomes small, and the frictional contact force of the photosensitive drum 4 by the magnetic brush held on the developing sleeve 3 becomes great and the sweep trace by the magnetic brush occurs to an image or the surface of the photosensitive drum 4 is injured and a streak appears on the image, and there also arises the problem that the lifetime of the photosensitive drum 4 becomes short.

As described above, the development gap method can estimate the lifetime about the development efficiency and the edge effect. Also, like the development gap method, other methods can also estimate the lifetime from the comparison with the data in the past with respect to the quality of image. In order to more remarkably judge the deterioration of the developer which is a cause of the deterioration of the quality of image, the developing conditions can be extremely changed and fed back to the characteristic values and physical property value, and can be judged from the quality of image.

In order to judge whether the amount of change in the quality of image is within an allowable range, the magnitude of the latitude can be confirmed and compared with the data in the past to thereby confirm the lifetime of the developer.

A description will now be made of a method of detecting the state of the developer adhering onto the photosensitive drum 4.

Popular density detecting methods include a method of measuring the density after fixing, a method of measuring the density on the intermediate transfer member (intermediate transfer belt 27), and a method of measuring the density on the image bearing member (photosensitive drum 4).

In the present embodiment, the density judgment by a heretofore adopted patch detecting method is carried out.

Figure 6:
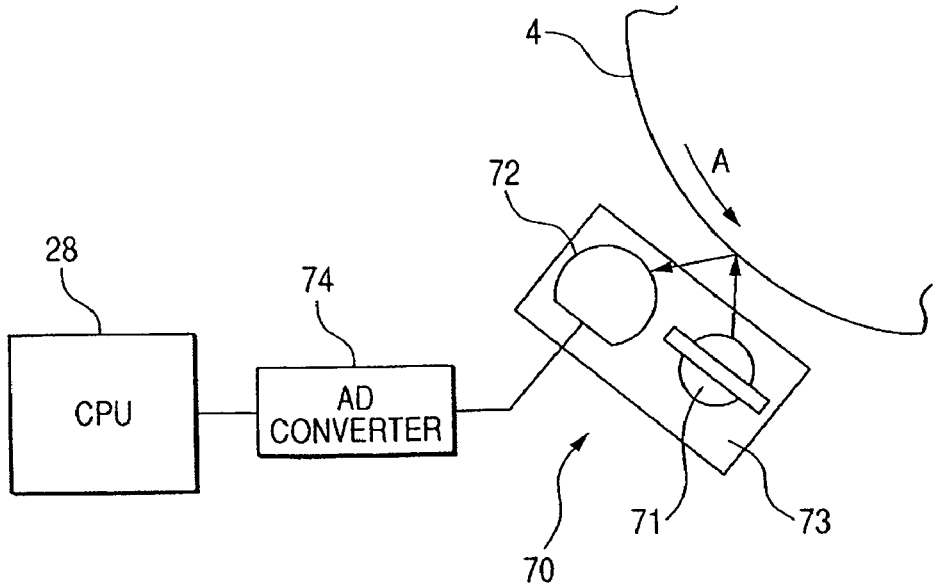
FIG. 6 is a schematic view illustrating a patch detecting method.

FIG. 1 shows the place of patch detection, and FIG. 6 shows the detailed patch detection.

Downstream of the portion in which the developing apparatus 9*a* and the photosensitive drum 4 are opposed to each other with respect to the rotation direction of the photosensitive drum, a patch detecting sensor 70 which is density detecting means is disposed in opposed relationship with the photosensitive drum 4. FIG. 6 shows a schematic enlarged view.

This patch detecting sensor 70 detects the reflection density of a toner patch formed by developing the reference latent image of a predetermined test pattern on the photosensitive drum 4, by irradiating the photosensitive drum 4 by a light emitting element 71 such as an LED, receiving reflected light by a light receiving element 72 and converting it by an A/D converter 74, and thereafter introducing it into and processing it by the CPU 28.

The reference latent image is formed by charging the photosensitive drum 4 to predetermined potential by the charger 21, and subjecting it predetermined exposure by a laser E, and is developed by the developing apparatus 9*a*. When the toner patch formed in this manner comes to a portion opposed to the patch detecting sensor 70, light of a wavelength of the order of 960 nm emitted from the light emitting element 71 in the patch detecting sensor 70 is reflected by the toner patch, and arrives at the light receiving element 72 in the patch detecting sensor 70, whereby an output voltage V is obtained.

Figure 7:
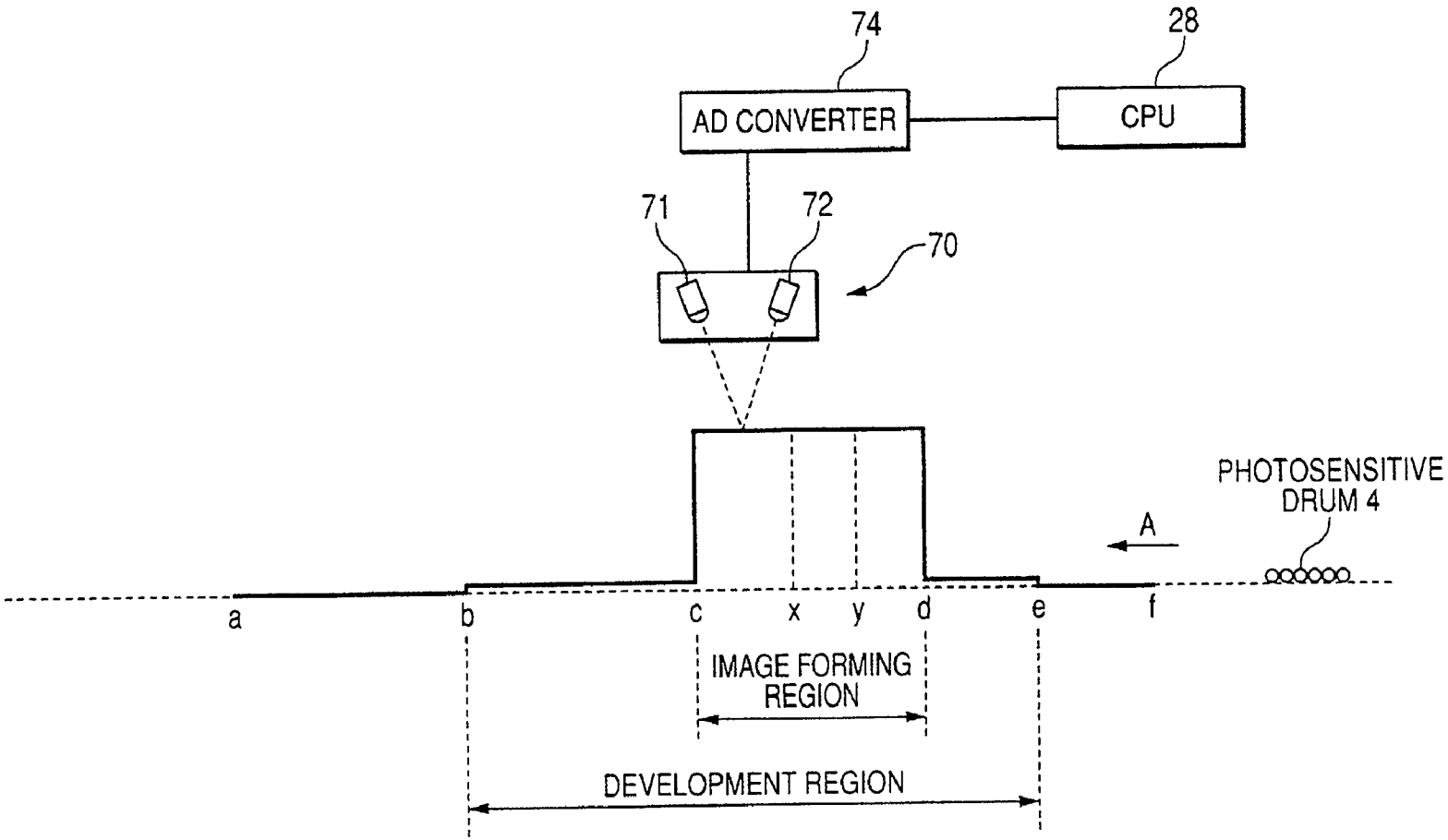
FIG. 7 illustrates the operation of the patch detecting method.

FIG. 7 is a developed view of the photosensitive drum 4, and is an image formed on the photosensitive drum 4.

The photosensitive drum 4 is operated in the direction indicated by the arrow A. After an image forming sequence operation is started, the amount of toner bearing is detected from a predetermined position "a" on the photosensitive drum 4 by the patch detecting sensor 70. The operation of the developing means is started from a point "b" and the amount of toner bearing of fog is detected. A patch image of predetermined density is formed between points "c" to "d", and the developing operation is terminated at a point "e", and the detection by the patch detecting sensor 70 is terminated at a point "f". The signal detected by the patch detecting sensor 70 is A/D-converted by the A/D converter 74, and is processed by the control device (CPU) 28.

Figure 8:
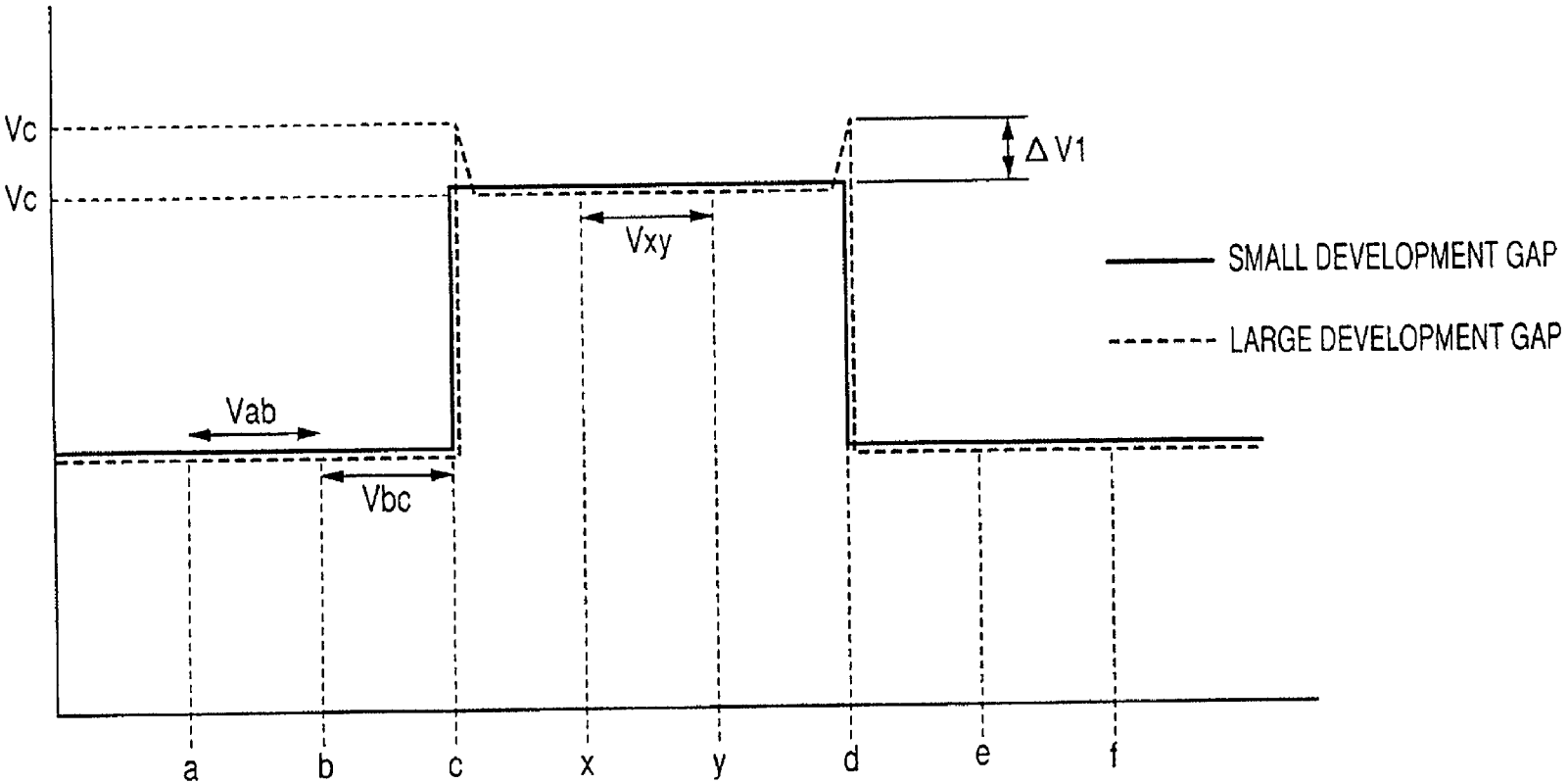
FIG. 8 illustrates the principle of the operation of the patch detecting method.

FIG. 8 is an image view representing the signal lead by the patch detecting sensor 70 by a timer axis. A solid line indicates the sensor output of the developed image when the development gap G is small, and a dotted line indicates the sensor output of the developed image when the development gap G is in a large state. The density detection of a predetermined image is effected at a zone "c"-"d", but at the edge portions of the points "c" and "d", the toner concentrates and the amount of toner bearing increases.

The amount of toner bearing and the sensor output can be primarily determined and therefore, the difference in the sensor output becomes the difference in the amount of toner bearing. This sensor output difference is defined as AV1. AV1 represents the edge effect. Although not shown, it could be confirmed that at this time, the development gap G is changed by 200 μm, whereby ΔV1 is changed by 0.5 V. From the comparison with the data in the past, it has been found that the lifetime of the developer is the remaining 20 k sheets.

Besides, Vab represents the photosensitive drum detection, Vbc represents the fog toner detection, Vc represents the leading edge detection, Vxy represents the density detection, and Vd represents the trailing edge detection. These are compared with backed-up data when the conditions of the main body have been changed by endurance fluctuation, environmental fluctuation, the developing conditions, etc., whereby an abnormal state can be detected beforehand. Also, density irregularity can be calculated by the above-mentioned density detection, the particulate property can be calculated by the result of density detection when a test pattern is depicted by a halftone, the dot reproducibility can be calculated by the result of density detection when the test pattern is depicted by isolated dots (e.g. dots of 100 μm×100 μm), and the carrier adherence can be calculated by the result of density detection when the test pattern is a "solid image".

Figure 9:
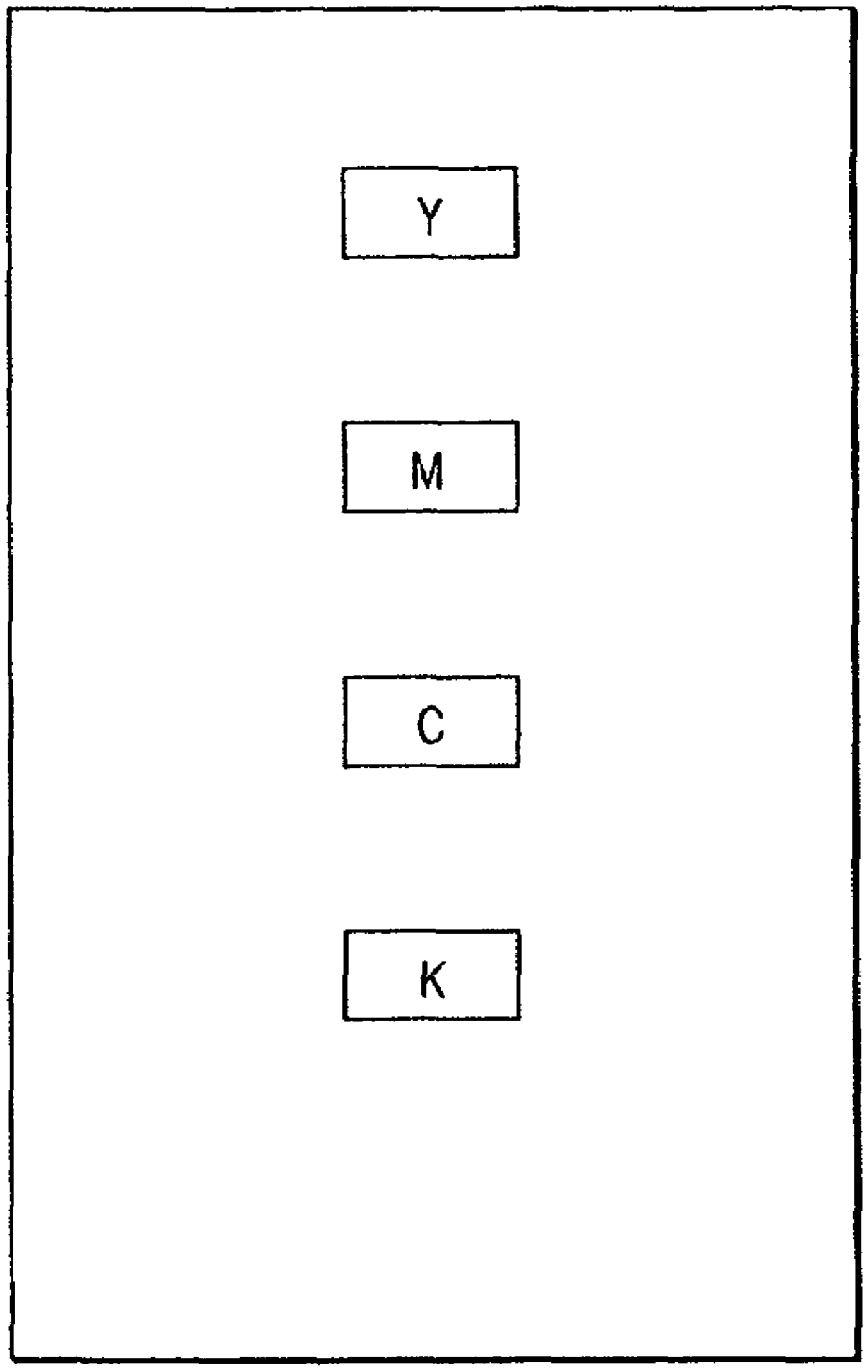
FIG. 9 is a schematic view illustrating a patch pattern.

The test pattern in the present embodiment adopts such a style as shown in FIG. 9. By forming a pattern of each color, it is possible to effect the detection of the density of each color, the white spot and an image such as a white streak on the edge portion.

Figure 10:
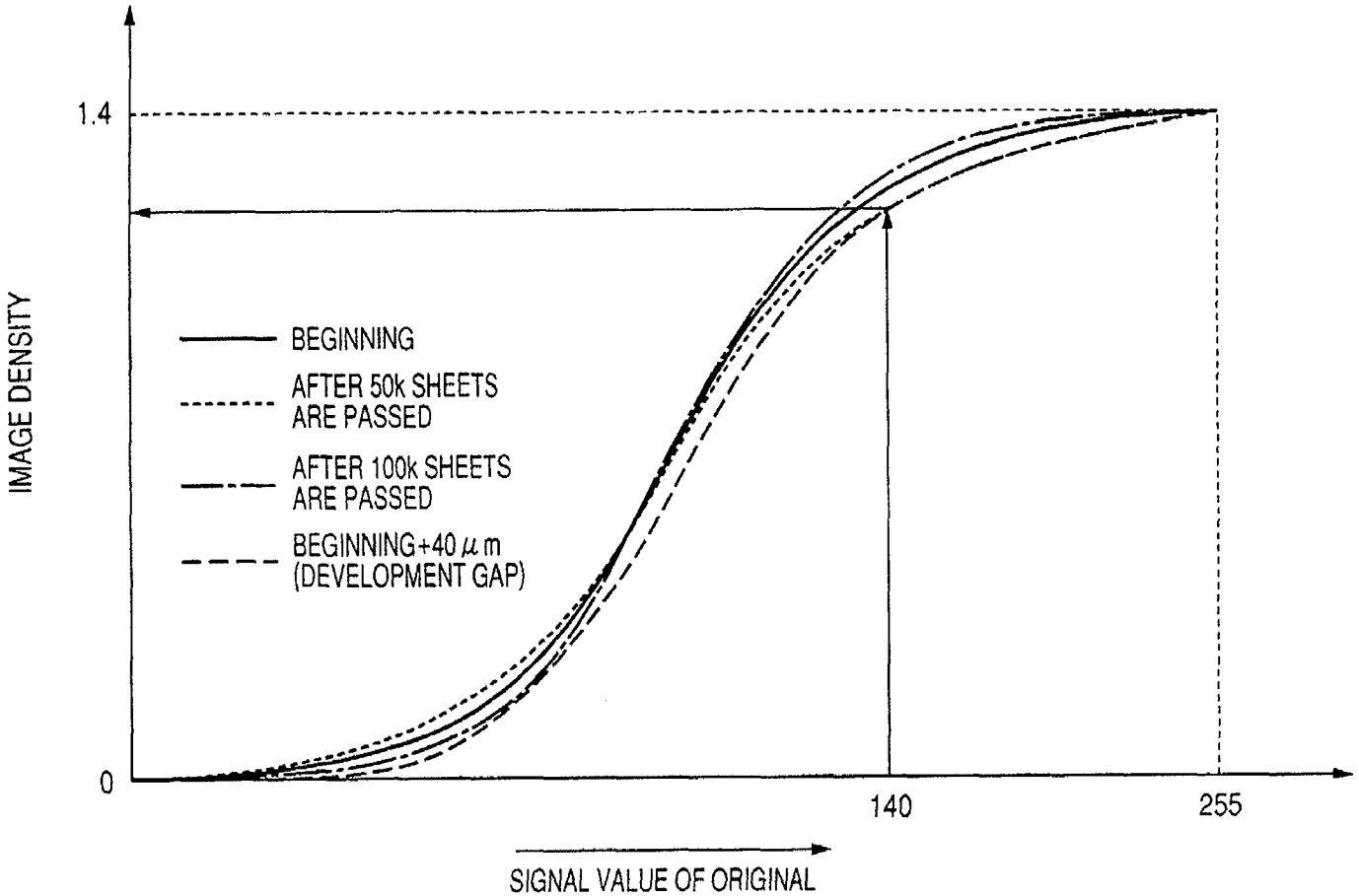
FIG. 10 is a graph showing a change in a developing characteristic.

FIG. 10 shows the development characteristics at the beginning and after the endurance test (after 50 k sheets and 100 k sheets are passed.) It further shows the development characteristic when the development gap G is changed by 40 μm. From FIG. 10, it can be seen that the gap is made larger by 40 μm than the initial value, whereby the signal value of an original coincides with that after 50 k sheets are passed at the position of about 140. That is, it has become clear that the development gap G is changed and the image density (patch density) is detected, whereby it is possible to estimate the lifetime of the developer.

That is, in the conventional detecting method, the density at the beginning and the density of a high contrast portion of 50 k sheets after endurance testing are almost the same and whether the developer is deteriorated cannot be judged. In the present embodiment, the development gap is forcibly made small, whereby the density fluctuation of a high contrast portion can be judged and the accuracy of the estimate of the lifetime is also improved.

It is most important to adopt a countermeasure at appropriate timing in accordance with the lifetime estimated by the result of density detection by the foregoing developing condition changing method.

A method of detecting the latitudes of the various developers described above will further be specifically described in Embodiments 2 to 9 and Embodiment 10.

The influence upon the quality of image when the respective parameters are changed is shown in Table 3. This is a result obtained by changing the respective parameters and evaluating the quality of image after the image forming apparatus is installed and 10 k sheets are passed.

Usually, when in Table 3, each parameter described as the condition of the "center value" is not greatly changed, reference is had to "Ref" on the right side. It can be seen that the greater is the difference, the higher is the sensitivity. The higher is the sensitivity, it is possible to detect the latitude at an earlier period and more accurately.

Embodiment 2

Figure 11:
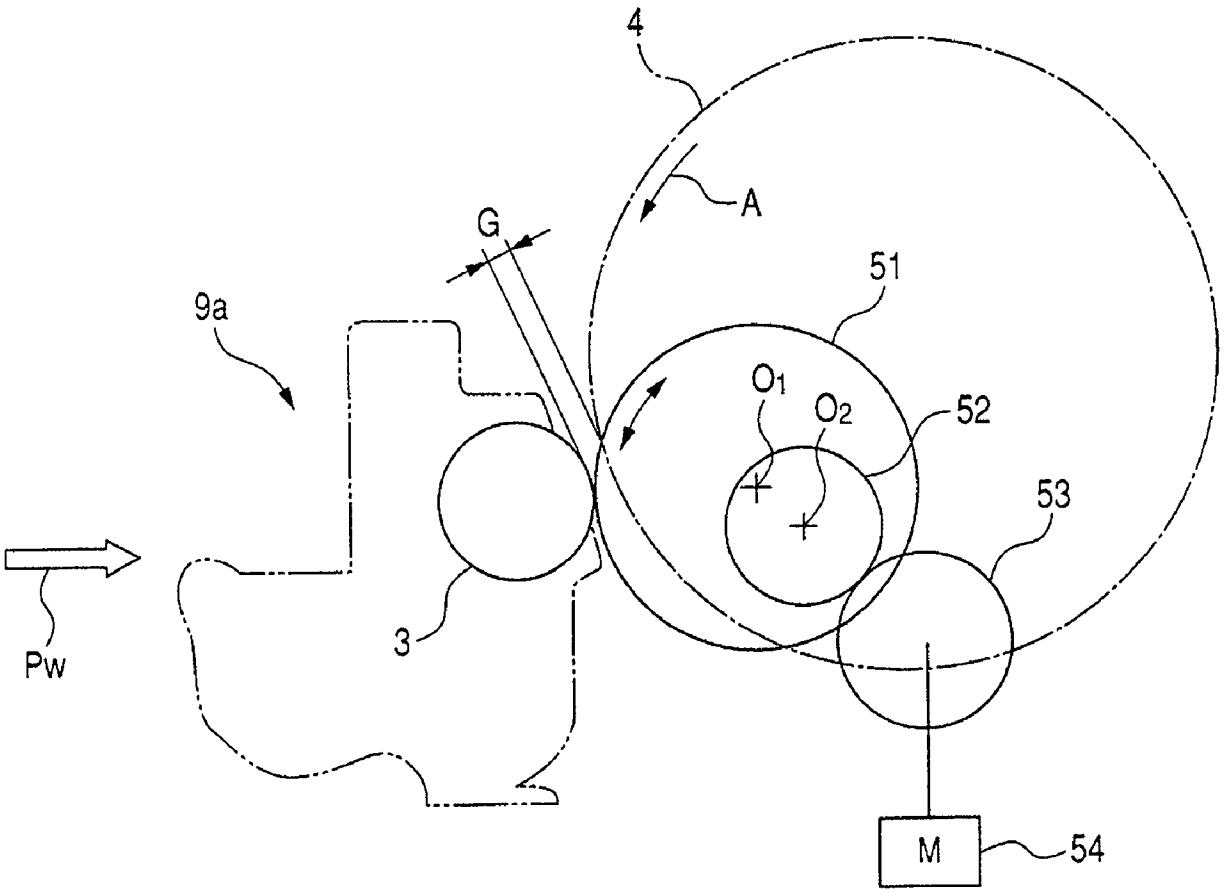
FIG. 11 schematically illustrates the construction of a development gap changing method.

A description will now be more specifically made of the method of changing the development gap G described in Embodiment 1, i.e., the distance changing means for changing the distance between the image bearing member and the developer carrying member. FIG. 11 shows an SD gap adjusting method.

The rotary developing apparatus 9 described in Embodiment 1 in connection with FIGS. 1 and 2 has, in the present embodiment, four developing devices 9*a*, 9*b*, 9*c* and 9*d* supported on a rotatably journalled rotary member 42. The four developing devices 9*a*, 9*b*, 9*c* and 9*d* are similar in construction and action to one another and therefore, in the present embodiment, the developing device 9*a* will be described.

The developing device 9*a* forms a certain constant gap (development gap G) with respect to the photosensitive drum 4 through a developing eccentric runner 51 rotated about a position O2 eccentric by a predetermined distance from the center O1. The developing eccentric runner 51 is mounted at a non-image position on this side and the inner part side. The developing device 9*a* is urged from behind itself with predetermined pressure PW to thereby stabilize the development gap G. The eccentric runner 51 is driven by a drive motor 54 through a gear 52 and an idler gear 53 mounted integrally therewith, and can be freely rotated and stopped.

A description will now be made of a controlling mechanism for controlling the drive motor 54.

Figure 12:
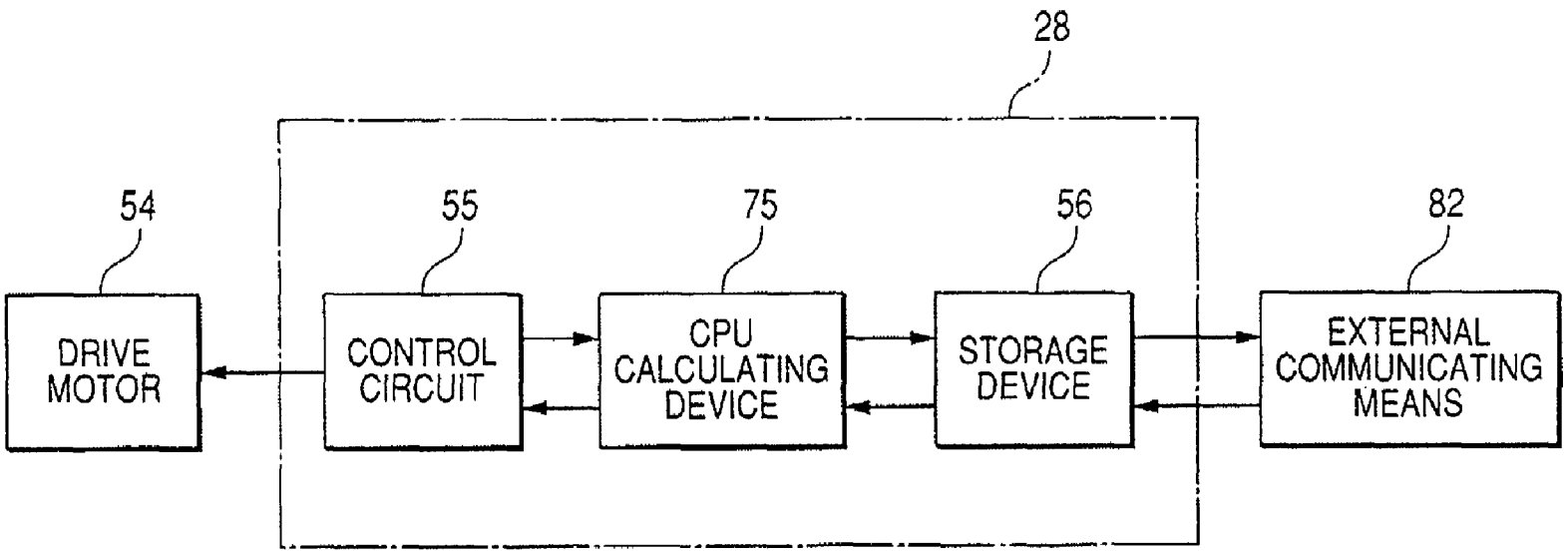
FIG. 12 is a control circuit diagram of an embodiment of the image forming apparatus according to the present invention.

FIG. 12 shows the mechanism for controlling the drive motor 54. The drive motor 54 can receive a signal from a control circuit 55 and rotate the eccentric runner 51 by a designated angle. Also, the control circuit 55 can transmit a signal to the drive motor 54 in accordance with the result of the calculation by a storage device 56 and a calculating device 75.

By using the controlling mechanism and the development gap changing method described above, it is possible to freely operate the development gap G.

In the present embodiment, there is adopted a method of estimating the deterioration of the developer in the image forming apparatus 100, and displaying it on the operating portion 200 of the main body to thereby warn the user or the serviceman.

Figure 13:
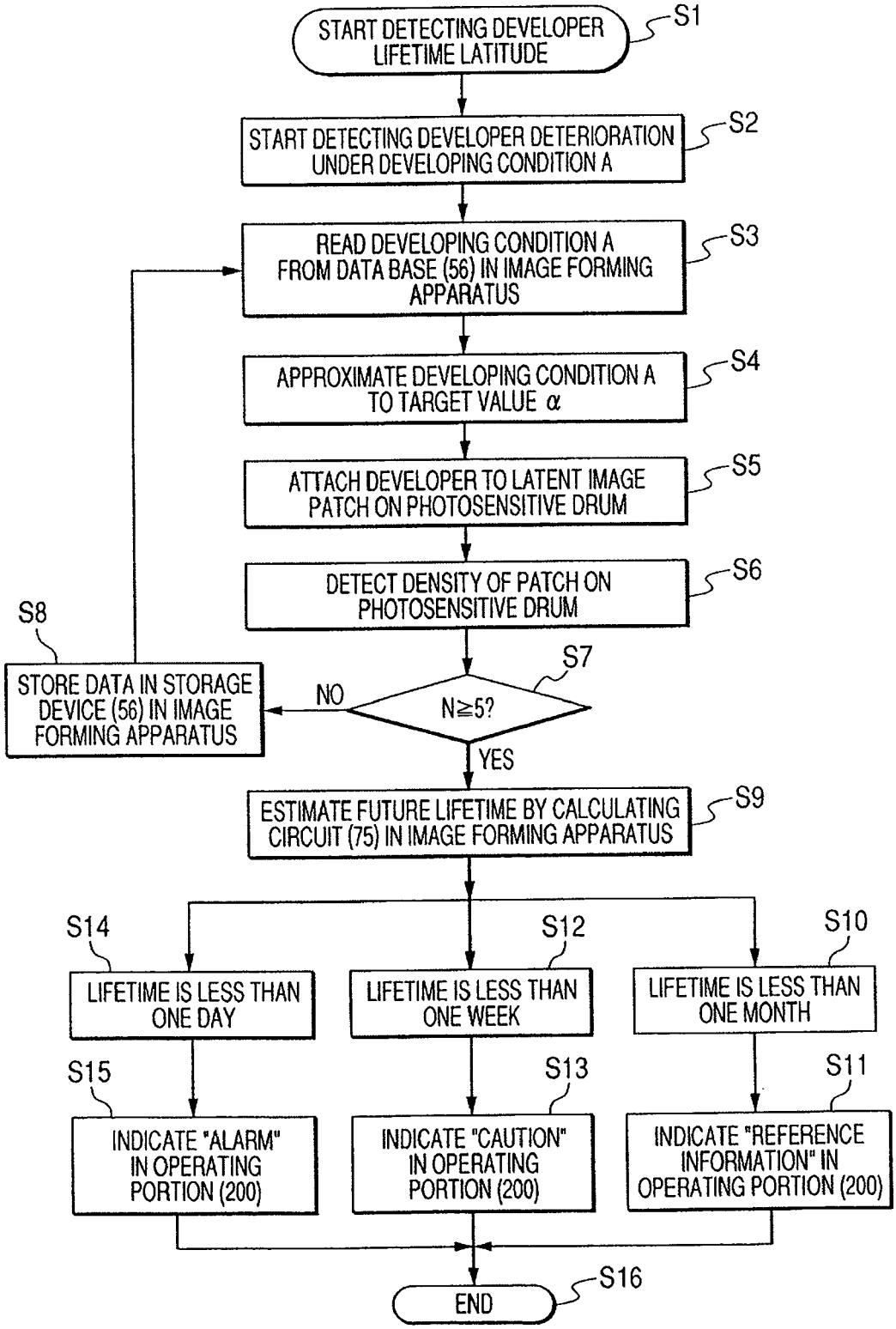
FIG. 13 is a flowchart of an embodiment illustrating a developer deterioration detecting sequence according to the present invention shown in Embodiments 2 to 9.

FIG. 13 is a flowchart illustrating a developer latitude detecting sequence in a developer latitude detecting mode.

When in FIG. 13, the user uses the image forming apparatus 100 for a predetermined period, the image forming apparatus 100 assumes the developer latitude detecting mode and starts the latitude detection of the developer, and determines what parameter (developing conditions) should be changed (S1). In the present embodiment, deterioration detection is started with the developing condition A for the detection of the developer deterioration as the development gap G (S2). The predetermined period can be arbitrarily set, and can be started, for example, each time a predetermined number of sheets are printed from the initial installation, or each time a predetermined time elapses. Also, in some cases, the deterioration detection can be effected each time the image forming apparatus is used for a predetermined period from after the completion of the printing of 10 k sheets, or from several months before the estimated lifetime.

A fluctuation amount for changing the development gap G from the center value is read from the data base of the storage device 56 of the Cpu 8 in the image forming apparatus 100 (S3). The drive motor 54 is then rotated in accordance with the afore-mentioned fluctuation amount to thereby more the gears 52, 53 and the eccentric runner 51, and adjust the developing condition A to a target value (α), i.e., in the present embodiment, a predetermined development gap G (S4).

Next, a patch pattern latent image is formed on the photosensitive drum 4, and the developer is made to adhere thereto (S5). The adhering developer is detected by a patch detecting method 70 to thereby examine the density, the fog, the white streak on the trailing edge, the edge effect, etc. (S6).

In the present embodiment, the frequency of detection is a predetermined frequency N, in the present embodiment, five times, and if the frequency N of detection is less than five times, the data thereof is preserved in the storage device 56 (S7 and S8), and access is again had to the storage device 56 to thereby fluctuate the development gap G again, and detect the state of the developer.

If the frequency of detection is five times or more, the data is forwarded to the calculating circuit 75 of the CPU 28 in the image forming apparatus to thereby check up each quality of image and calculate the estimated lifetime (S7 and S9).

If as the result, the lifetime is less than one month, the developer is still usable, and the remaining lifetime is indicated as "reference information" in the operating portion 200 (S10 and S11). Also, if the lifetime is only one week, the preparation of the developer is necessary and therefore, "caution" is indicated in the operating portion 200 (S12 and S13). Further, if the lifetime is less than one day, the lifetime of the developer exceeds an allowed value and therefore, such an evil as the scattering of the developer is feared. Therefore, an "alarm" is indicated in the operating portion 200 to thereby call upon the user not to use to the utmost (S14 and S15). Then, the developer latitude detecting mode is terminated (S16).

The calculation of the estimated lifetime by the present embodiment was effected on the basis of Table 3, and the lifetime of the developer could be estimated beforehand.

Specifically describing the sensitivity, by the development gap G being set to 250 μm, the density irregularity: 2.7 times, the absolute value of density: 1.0 time, the particulate property: no sensitivity, the white streak on the trailing edge: 2.0 times, the white spot: no sensitivity, the dot reproducibility: 1.5 times, the carrier adherence: 2.0 times, and the fog: 0.7 time, were obtained. By the development gap G being set to 750 μm, the density irregularity: 2.6 times, the absolute value of density: 1.0 time, the particulate property: 2.0, the white streak on the trailing edge: no sensitivity, the white spot: 2.0 times, the dot reproducibility: no sensitivity; the carrier adherence: no sensitivity, and the fog: no sensitivity, were obtained.

Thus, by the development gap G, as compared with the conventional methods, the density irregularity, the white streak on the trailing edge, the particulate property and the white spot can be detected beforehand. That is, the lifetime of the developer can be estimated beforehand.

Also, by the present embodiment, it has become apparent that as an example, in the conventional methods, the case where the lifetime is exceeded was 20% and the case where the developer is replaced within the lifetime thereof was about 15%, whereas in the present embodiment, the case of the reduction in triboelectricity due to the deterioration of the developer is within about 5.6% owing to the latitude detection by the development gap G. That is, as compared with the conventional methods, the present embodiment was effective to enhance the rate of operation of the copying machine.

A description will now be made as to how much the rate of operation is improved as compared with the conventional methods, by the improvement in sensitivity and the deterioration of the developer. The order of calculation of the lifetime will first be described.

The inspection of the latitude of the developer is started, and what parameters should be changed is determined. The parameters are actually changed to thereby detect the quality of image, and the result of the detection is compared with the data in the past and the lifetime of each quality of image is calculated. This is carried out during each predetermined period, and when the expected lifetime is reached, the developer is replaced before an image fault comes out.

Figure 14:
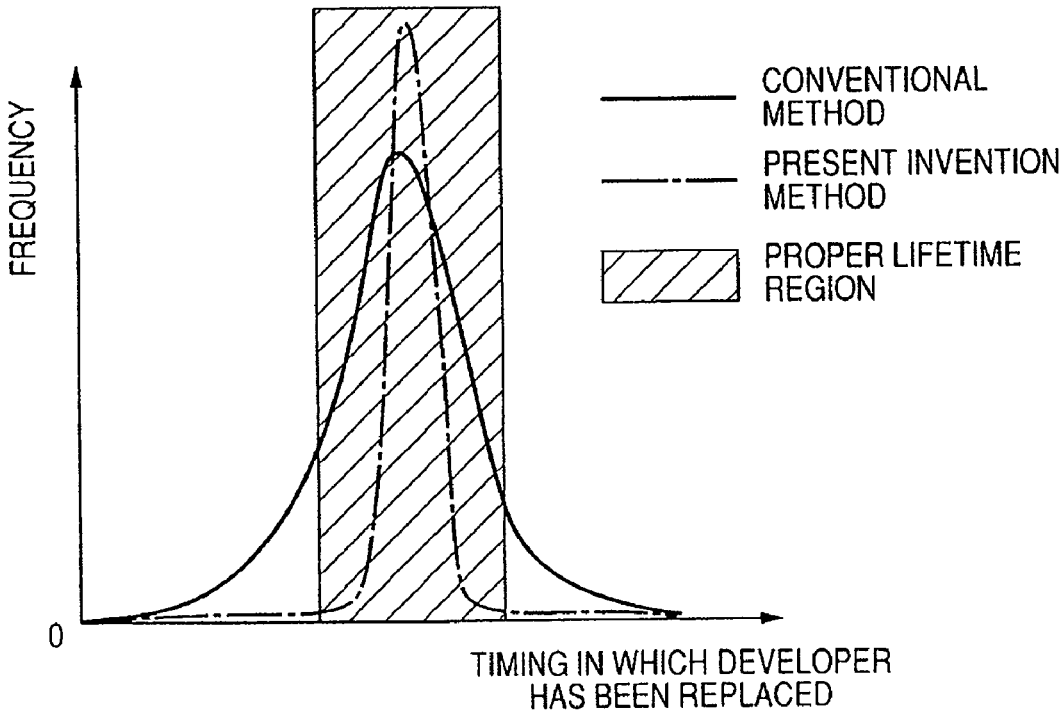
FIG. 14 is a graph showing the relation between the time when and the frequency with which the developer has been replaced.

FIG. 14 shows the result of the comparison made between the conventional method and the present embodiment with respect to the frequency of developer replacement.

The result is such that in the conventional method, from the region regarded as a proper lifetime range, a region in which the developer was replaced early was 15%, and a region exceeding the lifetime was 20%. In contrast, in the present embodiment, it can be seen that the lifetime is substantially within the proper lifetime range.

Figure 15:
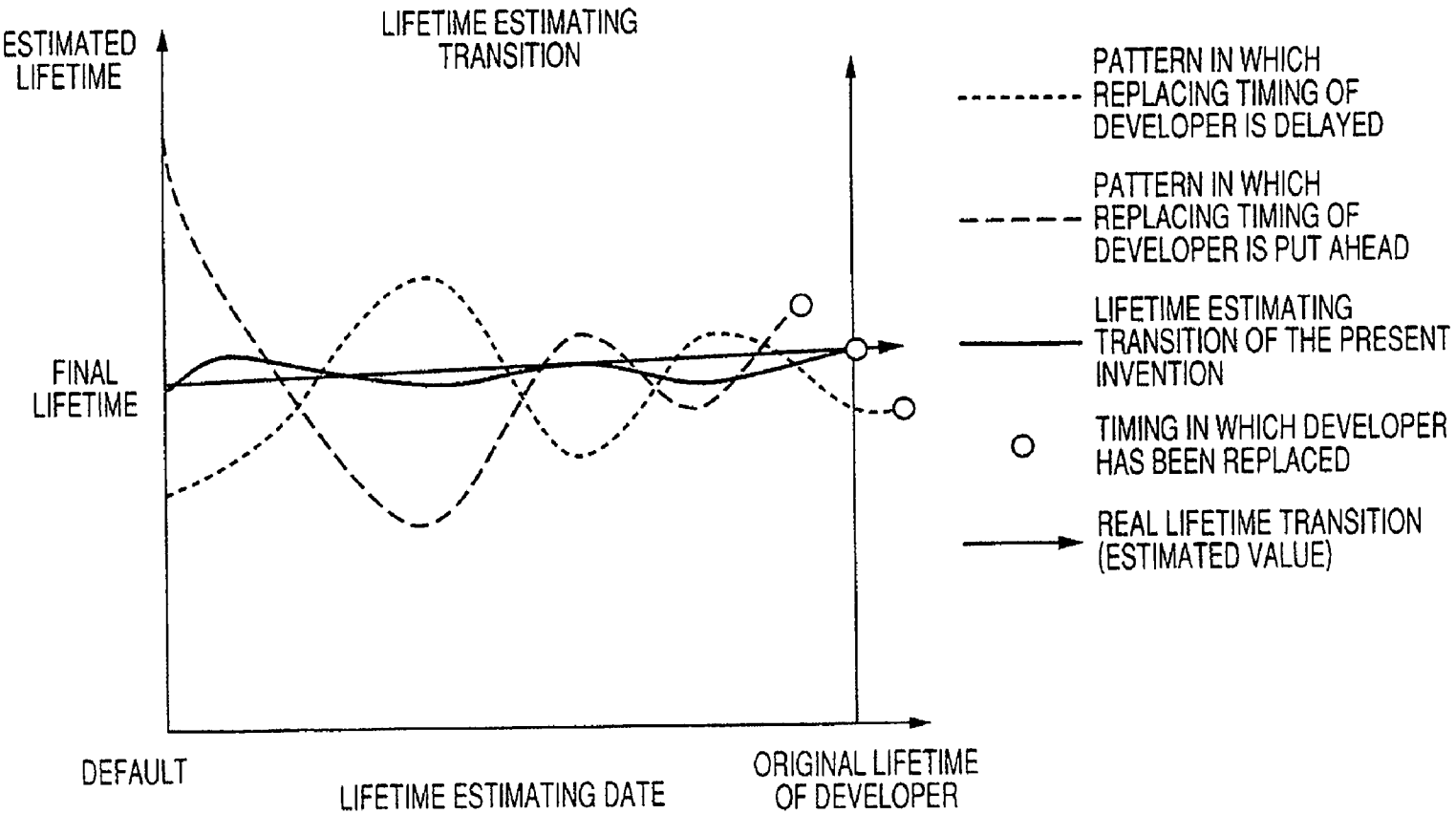
FIG. 15 is a graph showing the lifetime estimating transition of the developer.

Also, FIG. 15 shows the lifetime transitions in the conventional method and the present embodiment.

It can be seen that in the conventional method, the irregularity is very great from the beginning, relative to the lastly found final lifetime curve. In a pattern wherein the replacement was delayed, the lifetime is estimated as being short a little while after the initial installation, and conversely the lifetime is estimated as being long when the endurance test further progressed, the replacement was delayed as compared with the original lifetime, and an image fault actually occurred.

On the other hand, in the lifetime estimating method of the present embodiment, the lifetime is always presumed substantially in coincidence with the actual lifetime transition from the beginning and further, the developer replacing timing is also substantially the same as the target. As the result, the rate of operation was improved.

The developing conditions in the present embodiment are as follows, but they are an example to the last, and should desirably be optimized in accordance with the specification and condition of the image forming apparatus.

The peripheral speed of the developing sleeve 3 is 200 mm/sec., the distance between the developing sleeve 3 and the photosensitive drum 4 (hereinafter referred to as the "development gap") is 500 μm, the gap between the developing sleeve 3 and the blade 2 (hereinafter referred to as the "SB gap") is 600 μm, the AC voltage of the development bias is 2000 V, the frequency is 8 kHz, the dark potential is −600 V, the light potential is −50 V, the agitating speed of the developing device is 350 rpm, and the DC component of the development bias is −450 V, and as regards the main body conditions, the peripheral speed of the photosensitive drum 4 is 160 mm/sec., the diameter of the developing sleeve 3 is 25 mm, and the diameter of the photosensitive drum 4 is 84 mm. Also, as regards the initial values of the characteristic values of the developer, the TD ratio is 7.5%, the triboelectricity is 30 μC/g, the M/S is 0.55 mg/cm$^2$, the mean particle diameter of the toner is 7.5 μm, and the mean particle diameter of the carrier is 35 μm.

Embodiment 3

A description will now be made more specifically of the method of changing the peak potential of the AC component of the development bias which has been described in Embodiment 1.

In the present embodiment, the afore-mentioned peak potential can be arbitrarily changed by a high voltage circuit substrate (not shown). There is adopted a method of estimating the deterioration of the developer, and indicating the result of the estimate in the operating portion 200 of the main body to thereby warn the user or the serviceman.

The flowchart is the same as that of Embodiment 2. FIG. 13 shows a common flowchart illustrating the developer latitude detecting sequence in the developer latitude detecting mode. Operations similar to those in Embodiment 2 need not again be described.

In FIG. 13, when the user uses the image forming apparatus 100 for a predetermined period, the developer latitude detecting mode is assumed, and the latitude detection of the developer is started (S1). In the present embodiment, deterioration detection is started with the developing condition A for developer deterioration detection as the AC peak voltage of the development bias (S2).

From the data base of the storage device 56, a fluctuation amount for changing the AC peak voltage of the development bias from the center value is read and adjusted (S3 and S4). Then, a patch pattern latent image is formed on the photosensitive drum 4, and the developer is made to adhere thereto, and the adhering developer is detected by the patch detecting method 70, and the quality of image is investigated five time or more (S5 to S7). When the investigation is terminated, the data is forwarded to the calculating circuit 75 of the CPU 28 in the image forming apparatus to thereby check up each quality of image, and calculate the expected lifetime (S9). The coping with the result is the same as that in Embodiment 2.

As the result, from Table 3, the lifetime of the developer could be estimated beforehand.

Specifically describing the sensitivity, by Vpp being set to 500 V, the density irregularity: 2.2 times, the absolute value of density: 0.9 time, the particulate property: 2.0 times, the white streak on the trailing edge: no sensitivity, the white spot: no sensitivity, the dot reproducibility: 1.5 times, the carrier adherence: no sensitivity, and the fog: no sensitivity, were obtained. By Vpp being set to 3000 V, the density irregularity: no sensitivity, the absolute value of density: no sensitivity, the absolute value of density: no sensitivity, the particulate property: no sensitivity, the white streak on the trailing edge: 1.0 time, the white spot: 1.0 time, the dot reproducibility: no sensitivity, the carrier adherence: 1.5 times, and the fog: 3.0 times, were obtained. Thus, by the AC peak voltage of the development bias, the density irregularity, the particulate property and the fog can be detected as compared with the conventional methods. That is, the lifetime of the developer could be estimated beforehand.

Also, by the present embodiment, it has become apparent that as an example, in the conventional methods, the case where the lifetime is exceeded was 20% and the case where the developer is replaced within the lifetime was 15%, whereas in the present embodiment, such case is within about 5%.

That is, as compared with the conventional methods, there was the effect of enhancing the rate of operation of the copying machine.

The developing conditions in the present embodiment are the same as those in Embodiment 2, but they are an example to the last, and should desirably be optimized in accordance with the specification and condition of the image forming apparatus.

Embodiment 4

A description will now be made more specifically of the method of changing the frequency component of the development bias which has been described in Embodiment 1.

In the present embodiment, the afore-mentioned frequency can be arbitrarily changed by a high voltage substrate circuit (not shown). There is adopted a method of estimating the deterioration of the developer, and indicating the result of the estimate in the operating portion 200 of the main body to thereby warn the user or the serviceman.

The flowchart is the same as that in Embodiment 2. FIG. 13 shows a common flowchart illustrating the developer latitude detecting sequence in the developer latitude detecting mode. Operations similar to those in Embodiment 2 need not again be described.

In FIG. 13, when the user uses the image forming apparatus 100 for a predetermined period, the developer latitude detecting mode is assumed, and the latitude detection of the developer is started (S1). In the present embodiment, deterioration detection is started with the developing condition A for developer deterioration detection as the frequency of the development bias (S2).

From the data base of the storage device 56, a fluctuation amount for changing the frequency of the development bias from the center value is read and adjusted (S3 and S4). Then, a patch pattern latent image is formed on the photosensitive drum 4, and the developer is made to adhere thereto, and the adhering developer is detected by the patch detecting method 70 to thereby investigate the quality of image five times or more (S5 to S7). When the investigation is terminated, the data is forwarded to the calculating circuit 75 of the CPU 28 in the image forming apparatus to thereby check up each quality of image, and calculate the expected lifetime (S9). The coping with the result is the same as that in Embodiment 2.

As the result, from Table 3, the lifetime of the developer could be estimated beforehand.

Specifically describing the sensitivity, by the frequency being set to 4 kHz, the density irregularity: 1.3 times, the absolute value of density: 1.0 times, the particulate property: 1.0 time, the white streak on the trailing edge: no sensitivity, the white spot: 1.0, the dot reproducibility: 1.0 time, the carrier adherence: no sensitivity, and the fog: 1.7 times, were obtained. By the frequency being set to 12 kHz, the density irregularity: 0.4 time, the absolute value of density: 1.0 time, the particulate property: no sensitivity, the white streak on the trailing edge: no sensitivity, the white spot: no sensitivity, the dot reproducibility: no sensitivity, the carrier adherence: 1.5 times, and the fog: no sensitivity, were obtained.

Thus, as compared with the conventional methods, the fog and the carrier adherence can be detected more quickly by the frequency. That is, the lifetime of the developer could be estimated beforehand.

Also, by the present embodiment, it has become apparent that as an example, in the conventional method, the case where the lifetime is exceeded is 20% and the case where the developer is replaced within the lifetime is 15%, whereas in the present embodiment, the both cases are within 10%. That is, there was the effect of enhancing the rate of operation of the copying machine.

The developing conditions in the present embodiment are the same as those in Embodiment 2, but they are an example to the last, and should desirably be optimized in accordance with the specification and condition of the image forming apparatus.

Embodiment 5

The method of changing the development bias $V_{DC}$ which has been described in Embodiment 1 will now be described more specifically.

In the present embodiment, the afore-mentioned $V_{DC}$ can be arbitrarily changed by a high voltage substrate circuit (not shown). There is adopted a method of estimating the deterioration of the developer, and indicating the result of the estimate in the operating portion of the main body to thereby warn the user or the serviceman.

The flowchart is the same as that in Embodiment 2. FIG. 13 shows a common flowchart illustrating the developer latitude detecting sequence in the developer latitude detecting mode. Operations similar to those in Embodiment 2 need not again be described.

In FIG. 13, when the user uses the image forming apparatus 100 for a predetermined period, the developer latitude detecting mode is assumed, and the latitude detection of the developer is started (S1). In the present embodiment, deterioration detection is started with the developing condition A for developer deterioration detection as the development bias $V_{DC}$ (S2).

From the data base of the storage device 56, a fluctuation amount for changing the development bias $V_{DC}$ from the center value is read and adjusted (S3 and S4). Then, a patch pattern latent image is formed on the photosensitive drum, and the developer is made to adhere thereto, and the adhering developer is detected by the patch detecting method 70 to thereby investigate the quality of image five times or more (S5 to S7). When the investigation is terminated, the data is forwarded to the calculating circuit 75 of the CPU 28 in the image forming apparatus to thereby check up each quality of image, and calculate the estimated lifetime (S9). The coping with the result is the same as that in Embodiment 2.

As the result, from Table 3, the lifetime of the developer could be estimated beforehand.

Specifically describing the sensitivity, by $V_{DC}$ being set to 0 V, the density irregularity: 3.3 times, the absolute value of density: 0.7 time, the particulate property: 1.5 times, the white streak on the trailing edge: no sensitivity, the white spot: no sensitivity, the dot reproducibility: 1.5 times, the carrier adherence: 1.5 times, and the fog: 4.0 times, were obtained. By $V_{DC}$ being set to −800 V, the density irregularity: no sensitivity, the absolute value of density: no sensitivity, the particulate property: no sensitivity, the white streak on the trailing edge: no sensitivity, the white spot: 1.0 time, the dot reproducibility: 2.0 times, the carrier adherence: no sensitivity, and the fog: 4.0 times, were obtained. Thus, as compared with the conventional methods, the fog, the density irregularity and the dot reproducibility can be detected more quickly. That is, the lifetime of the developer could be estimated beforehand.

Also, by the present embodiment, it has become apparent that as an example, in the conventional methods, the case where the lifetime is exceeded is 20% and the case where the developer is replaced within the lifetime is 15%, whereas in the present embodiment, the both cases are within 3.5%. That is, as compared with the conventional methods, there was the effect of enhancing the rate of operation of the copying machine.

The developing conditions in the present embodiment are the same as those in Embodiment 2, but they are an example to the last, and should desirably be optimized in accordance with the specification and condition of the image forming apparatus.

Embodiment 6

A description will now be made more specifically of the method of changing the peripheral speed ratio of the developing sleeve 3 to the photosensitive drum which has been described in Embodiment 1.

In the present embodiment, the peripheral speed ratio of the developing sleeve 3 can be arbitrarily changed by the developing sleeve driving speed changing means 130 which is the rotating speed changing means for the developer carrying member. There is adopted a method of estimating the deterioration of the developer, and indicating the result of the estimate in the operating portion 200 of the main body 100 to thereby warn the user or the serviceman.

The flowchart is the same as that in Embodiment 2. FIG. 13 shows a common flowchart illustrating the developer latitude detecting sequence in the developer latitude detecting mode. Operations similar to those in Embodiment 2 need not again be described.

In FIG. 13, when the user uses the image forming apparatus 100 for a predetermined period, the developer latitude detecting mode is assumed, and the latitude detection of the developer is started (S1). In the present embodiment, deterioration detection is started with the developing condition A for developer deterioration detection as the afore-mentioned peripheral speed ratio of the developing sleeve 3 (S2).

From the data base of the storage device 56, a fluctuation amount for changing the afore-mentioned peripheral speed ratio of the developing sleeve 3 from the center value is read and adjusted (S3 and S4). Then, a patch pattern latent image is formed on the photosensitive drum 4, and the developer is made to adhere thereto, and the adhering developer is detected by the patch detecting method to thereby investigate the quality of image five times or more (S5 to S7). When the investigation is terminated, the data is forwarded to the calculating circuit 75 of the CPU 28 in the image forming apparatus to thereby check up each quality of image, and calculate the expected lifetime (S9). The coping with the result is the same as that in Embodiment 1.

As the result, from Table 3, the lifetime of the developer could be estimated beforehand.

Specifically describing the sensitivity, by the peripheral speed ratio of the developing sleeve 3 being set to 80%, the density irregularity: 2.5 times, the absolute value of density: 0.9 time, the particulate property: no sensitivity, the white streak on the trailing edge: no sensitivity, the white spot: 1.0 time, the dot reproducibility: 1.0 time, the carrier adherence: no sensitivity, and the fog: no sensitivity, were obtained. By the peripheral speed ratio of the developing sleeve 3 being set to 200%, the density irregularity: no sensitivity, the absolute value of density: no sensitivity, the particulate property: 2.0 times, the white streak on the trailing edge: 2.5 times, the white spot: no sensitivity, the dot reproducibility: 1.0 time, the carrier adherence: no sensitivity, and the fog: 0.7 time, were obtained. Thus, by the peripheral speed ratio of the developing sleeve 3, as compared with the conventional methods, the density irregularity, the particulate property and the white streak on the trailing edge portion can be detected more quickly. That is, the lifetime of the developer could be estimated beforehand.

Also, by the present embodiment, it has become apparent that as an example, in the conventional method, the case where the lifetime is exceeded is 20% and the case where the developer is replaced within the lifetime is 15%, whereas in the present embodiment, the both cases are within 6%. That is, as compared with the conventional methods, there was the effect of enhancing the rate of operation of the copying machine.

The developing conditions in the present embodiment are the same as those in Embodiment 2, but they are an example to the last, and should desirably be optimized in accordance with the specification and condition of the image forming apparatus.

Embodiment 7

A description will be made more specifically of the method of changing the developer agitating speed of the agitating screws 11 and 12 which has been described in Embodiment 1.

In the present embodiment, the agitating speed of the first and second agitating screws 11 and 12 can be arbitrarily changed by agitating screw rotating speed changing means 110. There is adopted a method of estimating the deterioration of the developer, and indicating the result of the estimate in the operating portion 200 of the main body to thereby warn the user or the serviceman.

The flowchart is the same as that in Embodiment 2. FIG. 13 shows a common flowchart illustrating the developer latitude detecting sequence in the developer latitude detecting mode. Operations similar to those in Embodiment 2 need not again be described.

In FIG. 13, when the user uses the image forming apparatus 100 for a predetermined period, the developer latitude detecting mode is assumed, and the latitude detection of the developer is started (S1 and S2). In the present embodiment, deterioration detection is started with the developing condition A for developer deterioration detection as the afore-mentioned agitating speed.

From the data base of the storage device 56, a fluctuation amount for changing the afore-mentioned agitating speed from the center value is read and adjusted (S3 and S4). Then, a patch pattern latent image is formed on the photosensitive drum 4, and the developer is made to adhere thereto, and the adhering developer is detected by the patch detecting method 70 to thereby investigate the quality of image five times or more (S5 to S7). When the investigation is terminated, the data is forwarded to the calculating circuit 75 of the CPU 28 in the image forming apparatus to thereby check up each quality of image, and calculate the expected lifetime (S9). The coping with the result is the same as that in Embodiment 2.

As the result, from Table 3, the lifetime of the developer could be estimated beforehand.

Specifically describing the sensitivity, by the agitating speed being set to 60 rpm, the density irregularity: 1.7 times, the absolute value of density: 1.0 time, the particulate property: 1.0 times, the white streak on the trailing edge: no sensitivity, the white spot: 1.0 time, the dot reproducibility: 1.0 time, the carrier adherence: no sensitivity, and the fog: 0.7 time, were obtained. By the agitating speed being set to 1000 rpm, the density irregularity: 3.1 times, the absolute value of density: 0.9 times, the particulate property 2.0 times, the white streak on the trailing edge 1.5 times, the white spot: no sensitivity, the dot reproducibility: 1.0 time, the carrier adherence: no sensitivity, and the fog: 1.7 times, were obtained.

Thus, by the agitating speed, as compared with the conventional methods, the density irregularity, the particulate property and the white streak on the trailing edge portion can be detected more quickly. That is, the lifetime of the developer could be estimated beforehand.

Also, by the present embodiment, it has become apparent that as an example, in the conventional method, the case where the lifetime is exceeded is 20% and the case where the developer is replaced within the lifetime is 15%, whereas in the present embodiment, the both cases are within about 9%. That is, as compared with the conventional methods, there was the effect of enhancing the rate of operation of the copying machine.

The developing conditions in the present embodiment are the same as that in Embodiment 2, but they are an example to the last, and should desirably be optimized in accordance with the specification and condition of the image forming apparatus.

Embodiment 8

A description will now be made more specifically of the method of changing the SB gap (the distance between the developing sleeve and the developer regulating member) which has been described in Embodiment 1.

In the present embodiment, the developer regulating member can be moved by distance changing means 120 to thereby arbitrarily change the afore-mentioned SB gap. There is adopted a method of estimating the deterioration of the developer, and indicating the result of the estimate in the operating portion 200 of the main body to thereby warn the user or the serviceman.

The flowchart is the same as that in Embodiment 2. FIG. 13 shows a common flowchart illustrating the developer latitude detecting sequence in the developer latitude detecting mode. Operations similar to those in Embodiment 2 need not again be described.

In FIG. 13, when the user uses the image forming apparatus 100 for a predetermined period, the developer latitude detecting mode is assumed, and the latitude detection of the developer is started (S1 and S2). In the present embodiment, deterioration detection is started with the developing condition A for developer deterioration detection as the afore-mentioned SB gap.

From the data base of the storage device 56, a fluctuation amount for changing the afore-mentioned SB gap from the center value is read and adjusted (S3 and S4). Then, a patch pattern latent image is formed on the photosensitive drum 4, and the developer is made to adhere thereto, and the adhering developer is detected by the patch detecting method 70 to thereby investigate the quality of image five times or more (S5 to S7). When the investigation is terminated, the data is forwarded to the calculating circuit forwarded to the calculating circuit 75 of the CPU 28 in the image forming apparatus to thereby check up each quality of image, and calculate the expected lifetime (S9). The coping with the result is the same as that in Embodiment 2.

As the result, from Table 3, the lifetime of the developer could be estimated beforehand.

Specifically describing the sensitivity, by the SB gap being set to 300 μm, the density irregularity: 2.8 times, the absolute value of density: 0.9 time, the particulate property: 1.5 times, the white streak on the trailing edge: no sensitivity, the white spot: 2.0 times, the dot reproducibility: 1.5 times, the carrier adherence: no sensitivity, and the fog: no sensitivity, were obtained. By the SB gap being set to 1000 μm, the density irregularity: no sensitivity, the absolute value of density: no sensitivity, the particulate property: 1.5 times, the white streak on the trailing edge: 2.0 times, the white spot: no sensitivity, the dot reproducibility: no sensitivity, the carrier adherence: 2.5 times, and the fog: 0.7 time, were obtained.

Thus, by the SB gap, as compared with the conventional methods, the density irregularity, the particulate property, the white streak on the trailing edge, the dot reproducibility and the carrier adherence can be detected more quickly. That is, the lifetime of the developer could be estimated beforehand.

Also, by the present embodiment, it has become apparent that as an example, in the conventional method, the case where the lifetime is exceeded is 20% and the case where the developer is replaced within the lifetime is 15%, whereas in the present embodiment, the both cases are within about 5%. That is, as compared with the conventional methods, there was the effect of enhancing the rate of operation of the copying machine.

The developing conditions in the present embodiment are the same as those in Embodiment 1, but they are an example to the last, and should desirably be optimized in accordance with the specification and condition of the image forming apparatus.

Embodiment 9

A description will now be made more specifically of the method of changing the environment moisture amount which has been described in Embodiment 1.

In the present embodiment, the afore-mentioned environment moisture amount can be arbitrarily changed by environment moisture amount controlling means (not shown). There is adopted a method of estimating the deterioration of the developer, and indicating the result of the estimate in the operating portion 200 of the main body to thereby warn the user or the serviceman.

The flowchart is the same as that in Embodiment 2. FIG. 13 shows a common flowchart illustrating the developer latitude detecting sequence in the developer latitude detecting mode. Operations similar to those in Embodiment 2 need not again be described.

In FIG. 13, when the user uses the image forming apparatus 100 for a predetermined period, the developer latitude detecting mode is assumed, and the latitude detection of the developer is started (S1 and S2). In the present embodiment, deterioration detection is started with the developing condition A for developer deterioration detection as the afore-mentioned environment moisture amount.

From the data base of the storage device 56, a fluctuation amount for changing the afore-mentioned environment moisture amount from the center value is read and adjusted (S3 and S4). Then, a patch pattern latent image is formed on the photosensitive drum 4, and the developer is made to adhere thereto, and the adhering developer is detected by the patch detecting method 70 to thereby investigate the quality of image five times or more (S5 to S7). When the investigation is terminated, the data is forwarded to the calculating circuit 75 of the Cpu 28 in the image forming apparatus to thereby check up each quality of image, and calculate the expected lifetime (S9). The coping with the result is the same as that in Embodiment 1.

As the result, from Table 3, the lifetime of the developer could be estimated beforehand.

Specifically describing the sensitivity, by the environment moisture amount being set to 1 g/kg, the density irregularity: no sensitivity, the absolute value of density: 1.0 time, the particulate property: no sensitivity, the white streak on the trailing edge: no sensitivity, the white spot: 1.5 times, the dot reproducibility: no sensitivity, the carrier adherence: 2.0 times, and the fog: 2.3 times, were obtained. By the environment moisture amount being set to 21 g/kg, the density irregularity: 3.2 times, the absolute value of density: no sensitivity, the particulate property: 1.5 times, the white streak on the trailing edge: no sensitivity, the white spot: no sensitivity, the dot reproducibility: 2.0 times, the carrier adherence: no sensitivity, and the fog no sensitivity, were obtained.

Thus, by the environment moisture amount, as compared with the conventional methods, the density irregularity, the particulate property, the white spot, the dot reproducibility, the carrier adherence and the fog can be detected more quickly. That is, the lifetime of the developer could be estimated beforehand.

Also, by the present embodiment, it has become apparent that as an example, in the conventional method, the case where the lifetime is exceeded is 20% and the case where the developer is replaced within the lifetime is 15%, whereas in the present embodiment, the both cases are within about 4%. That is, as compared with the conventional methods, there was the effect of enhancing the rate of operation of the copying machine.

The developing conditions in the present embodiment are the same as those in Embodiment 1, but they are an example to the last, and should desirably optimized in accordance with the specification and condition of the image forming apparatus.

Embodiment 10

In the present embodiment, unlike Embodiments 2 to 9, there is adopted a method of forwarding the result of developer deterioration detected by the image forming apparatus 100 to a server, and informing the serviceman of the result.

A description will now be made of the method of informing the server of the detected developer deteriorated state.

Before describing the method, a description will first be made briefly of the serviceman's coping with the electrophotographic image forming apparatus in the existing condition.

In the electrophotography, from its speciality of utilizing static electricity for the user to find out the cause of an image fault when it has occurred, and cope with it.

It is also difficult for the serviceman to obtain an electrophotographic condition at a point of time whereat an image fault has occurred, and the parameters thereof are various. Further, even when the serviceman has arrived at the actual spot, the reproducibility of the image fault is scanty and therefore, it has been difficult to appropriately cope with the image fault actually in the market.

Also, in order to cope with these claims, the serviceman often replaces parts or the main body, and often replaces unnecessary parts because it is difficult to find out the cause, and this had led to the possibility of leading to an increase in service eest costs.

Many of these problems almost arise when the electrophotographic image forming condition set by the manufacturer is not adapted to the user's use environment and condition or when electrophotographic parts including the toner and the photosensitive drum are deteriorated or have got out of order.

If such information can be appropriately judged, it will be possible to find out the spot of trouble and designate parts to be replaced or instruct the user to adopt setting corresponding to the user's use situation and environment to thereby achieve a solution to the problems.

However, the parameters in electrophotography are often represented by a voltage value and a current value unfamiliar to ordinary users, and it is virtually impossible to require understanding and judgment of the user. The serviceman is also unable to have access to such information unless it is within a network and therefore, in the present situation, it has been difficult to change the electrophotographic parameters and cope with the problems.

Further, not only the number of the electrophotographic parameters is great, but also these parameters are closely related to one another, and it is rare that the problem is solved simply by changing one parameter. Conversely, by one parameter being simply changed, the balance of the system may be destroyed to thereby give rise to other problems, and it has been made difficult to change the electrophotographic parameters.

By comprehensibly providing the serviceman or the user with the result of the advance estimate of the deteriorated state of the developer due to the fluctuation of the development gap G which has been described above, it is eliminated to inadvertently change the parameters, and it is possible to execute the optimum maintenance timing. It requires a cost for the serviceman to directly go to the user's office and therefore, it is desirable to collect information from a remote place.

So, in the present embodiment, the information of the image forming apparatus main body is collected through the server and is reported to each business office.

Figure 16:
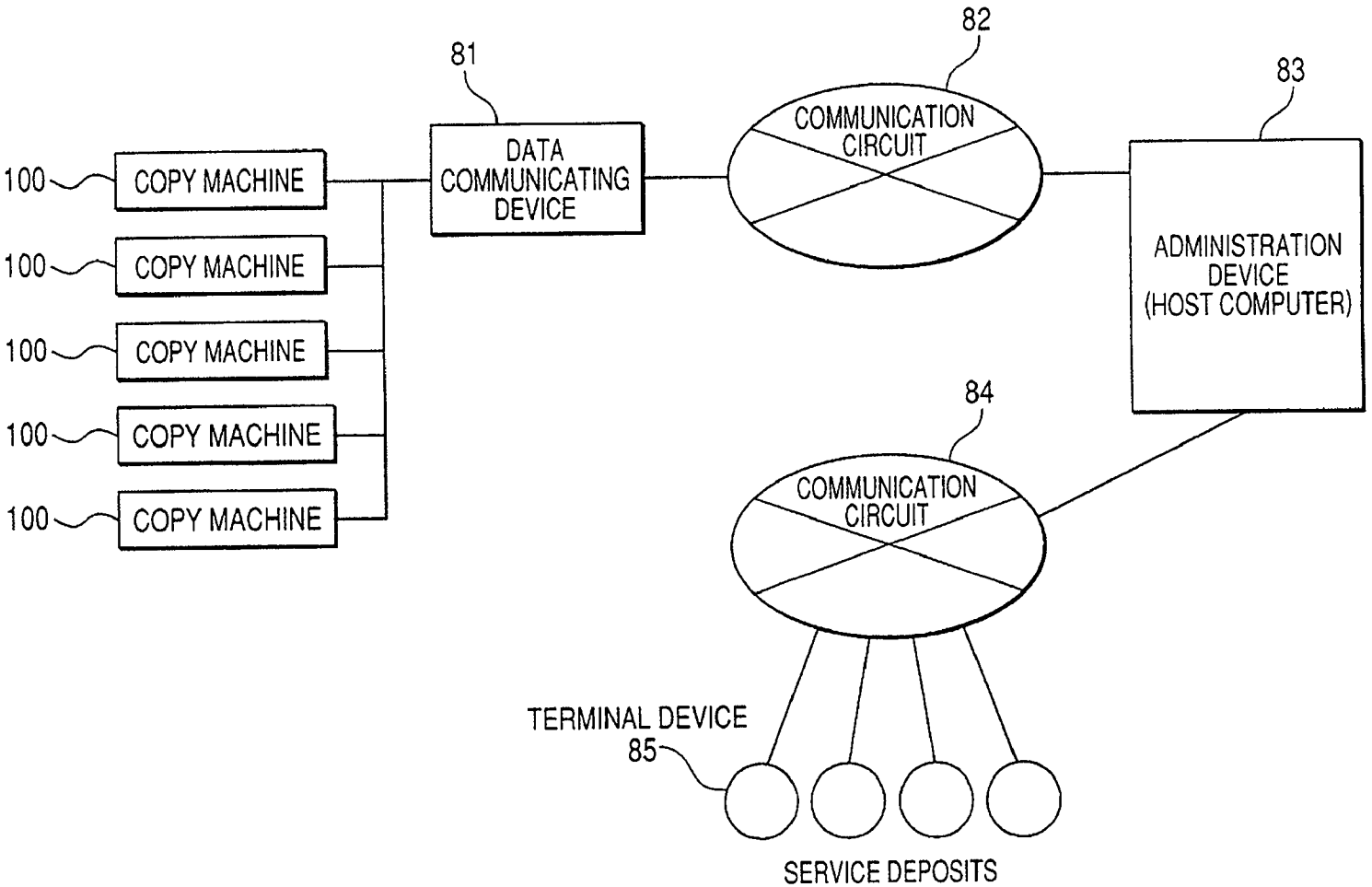
FIG. 16 is a schematic view of an embodiment of an image forming apparatus administrating system constructed in accordance with the present invention.

FIG. 16 shows a communicating method about the report to the server. The communicating method shown in FIG. 16 is a system construction showing an embodiment of an image forming apparatus administration system according to the present invention.

The system of the present embodiment is provided with a number of copying apparatuses 100 installed in places of use such as the user's offices, and image forming apparatuses 100 such as other many printers or facsimile apparatuses. These image forming apparatuses 100 are connected to a common administration device (host computer) 83 installed in an administration center (service center) through communicating means such as a data communicating device 81 and a communication circuit 82.

A terminal device 85 installed in each service deposit (service station) is connected to this administration device 83 through a communication circuit 84. A public circuit net such as a telephone circuit and the Internet can be utilized as the communication circuits 82 and 84.

Each image forming apparatus 100 in this image forming apparatus administration system has a communicating (a function as communicating means including transmitting means) necessary when reporting alarm information for in accordance with detected information in the image forming apparatus, and alarm information for informing of an abnormal advance matter if abnormal, and transmitting the alarm information to the administration device 83, or simply transmitting various kinds of information (data) representative of its own state to the administration device 83, or monitoring the state of each image forming apparatus 100 from the administration device 83.

The administration device 83 is a host computer, and is provided with an information storing portion (state information accumulating means) for accumulating therein state information representative of the state of each image forming apparatus 100. In this information storing portion, there is accumulated the state information of an electrophotography before the image forming apparatus 100 is installed in the user's office.

The administration device 83 is provided with the following functions:

the accumulation controlling function of receiving the state information transmitted from each image forming apparatus 100 and sequentially and individually accumulating the information in the information storing portion;

the image forming state determining function of processing (analyzing) the state information accumulated in the information storing portion, by the use of a learning logic function or the like, and calculating, estimating and determining the deteriorated state of the developer in the present situation for the image formation by each image forming apparatus 100;

the estimating function of estimating the abnormality or trouble of each image forming apparatus 100 about the state information received from each image forming apparatus 100 through a network; and the transmitting function of transmitting the result of the estimate by the estimating function to the terminal device 85 installed in the service deposits for controlling a desired image forming apparatus 100.

The terminal device 85 is a personal computer installed in each service deposit, and has the function of storing therein the information received from the administration device 83, and reporting the result of the estimate of the abnormality or trouble of the desired image forming apparatus 100, the destination of visit, etc. to the serviceman.

By using the above-described image forming apparatus administration system, the serviceman can quickly cope with the deterioration of the developer.

A maintenance method will now be described.

As described above, the maintenance method by the developer deterioration includes various operations such as the replacement of the developer, the replacement of the developing device 9 including the developer, and the replacement of a process cartridge including the photosensitive drum 4.

Also, as described above, as a lifetime prolonging measure, there is a degeneracy such as a method of reducing the process speed to thereby reduce the number of sheets to be produced to the utmost when the deterioration of the developer has drawn near or a method of making a chart of a high image percentage impossible to copy, etc., but this limits the user's using condition and therefore gives an unpleasant feeling to the user and thus, is not desirable.

So, in the present embodiment, there is adopted a countermeasure for considering how to curtail an unusable time from the user's standpoint as far as possible, and when the lifetime has been reached, coping with it on the spot.

Figure 17:
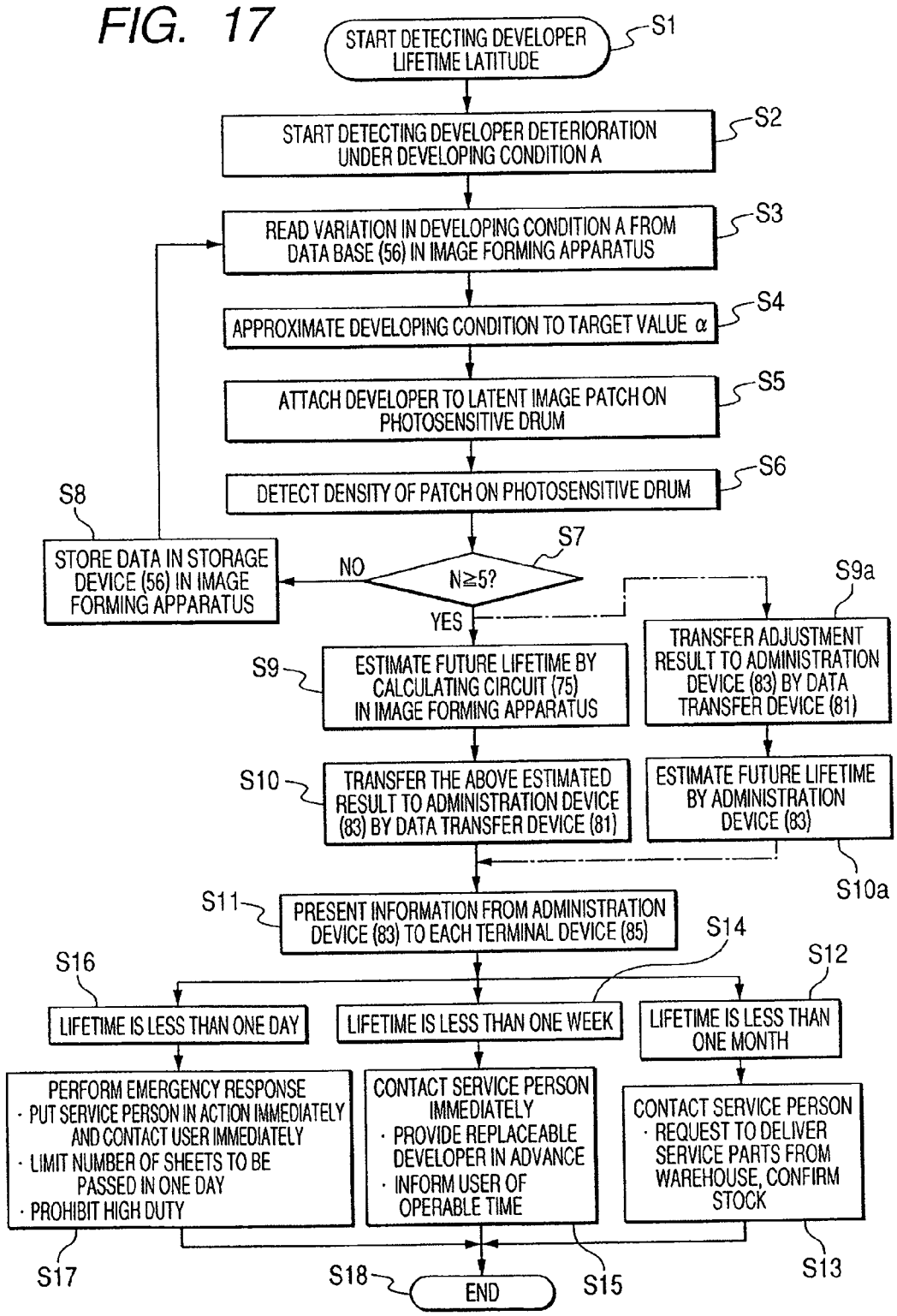
FIG. 17 is a flowchart of an embodiment illustrating a developer deterioration detecting sequence according to the present invention.

FIG. 17 shows a flowchart of the present Embodiment 10.

Up to the flow for detecting the patch density on the photosensitive drum 4 is the same as that in Embodiments 1 to 9 described above.

If here, the frequency checked up by the patch detecting method 70 is five times or more, the data is forwarded to the calculating circuit 75 of the CPU 28 in the image forming apparatus to thereby check up each quality of image and calculate the estimated lifetime (S7 and S9). The result is forwarded to the administration device 83 by the use of the communicating means such as the data communicating device 81 and the communication circuit 82 (S10).

In the flowchart shown in FIG. 17, it has been described that at the steps 9 and 10, the image forming apparatus calculates the estimated lifetime, and forwards the result to the administration device 83 by the communicating means. As another method, the image forming apparatus can immediately transmit information about the result of the inspection of the quality of image obtained by the steps 6 and 7 to the administration device 83 by the communicating means (S9*a*), and the administration device 83 can also estimate the lifetime of the developer in accordance with image quality investigation result information from the image forming apparatus (10*a*).

In any case, in the administration device 83, depending on the case, comparison with the data in the past, the preservation of novel data, the estimate of the lifetime of the developer, etc. are effected as described above (S9*a* and S10*a*), and the functions described above are fully performed, and the result is provided as information to each terminal 85 of the serviceman through communicating means such as a communication circuit 84 (S11).

If as the result, the lifetime is less than one month, the developer is still usable, and a request for the delivery of service parts from a warehouse and the confirmation of stock are carried out (S12 and S13). Also, when the lifetime is only one week, the preparation of the developer is carried out, and the stop time during the replacement of the developer is communicated to the user beforehand (S14 and S15). Further, when the lifetime is less than one day, the lifetime of the developer exceeds an allowable value and therefore, the serviceman carries out emergently going to the user's office, reporting the present situation to the user, and replacing the developer before the situation becomes more aggravated, or limiting the number of passed sheets per day by remote control (S16 and S17). Then, the flow is ended.

In the present embodiment, the sensitivity of the quality of image is the same as that in Embodiments 2 to 9. However, as compared with Embodiments 2 to 9, the lifetime of the quality if image can be known quickly, and from other serviceman's information, it becomes possible to consider the estimate in the future Accordingly, as compared with Embodiments 1 to 9, it is possible to see the estimate of the lifetime of the developer at real time and therefore, the case where the lifetime is exceeded could be decreased to 5%, and the case where the developer is replaced within the lifetime could be decreased to 5%.

Thus, in the present Embodiment 10, as compared with Embodiments 2 to 9, the operable time of the image forming apparatus is further increased and an effect can be obtained.

The developing conditions are the same as those in Embodiments 2 to 9, but they are an example to the last, and should desirably be optimized in accordance with the specification and condition of the image forming apparatus.

As described above, according to Embodiments 1 to 10, as compared with the conventional potential sensor detecting method, the counter detecting method, the patch detecting method and the development gap method, the latitude of the developer can be detected beforehand and it is possible to grasp the lifetime more accurately. Accordingly, there is the effect that the stop time of the image forming apparatus is decreased from 15 to 20% in the conventional art methods to the order of 5 to 9%.

Also, the methods described in the embodiments may in some cases bring about an effect several times as high as that at present, by a combination thereof.

According to Embodiment 10 described above, as compared with the conventional host computer detecting method, there is the effect of being capable of estimating the deterioration of the developer beforehand, and reporting it to the serviceman and greatly increasing the operable time. Further, the developer in the developer container can be replaced with a fresh developer at appropriate timing in accordance with the degree of deterioration of the developer to thereby provide images of high quality stably for a long period and further, greatly reduce the running costs.

Embodiment 11

In Embodiments 1 to 10 described above, the image forming apparatus 100 according to the present invention has been described as being of a construction which is provided with the photosensitive drum 4 as a rotatably carried image bearing member, the primary charger 21 and the exposing device 20, as the latent image forming means, and in which the electrostatic latent image on the photosensitive drum 4 is developed as a visible image, i.e., a toner image, by the toner being made to adhere to the latent image by the developing means which is the rotary developing apparatus 9 (9*a*, 9*b*, 9*c*, 9*d*).

Figure 18:
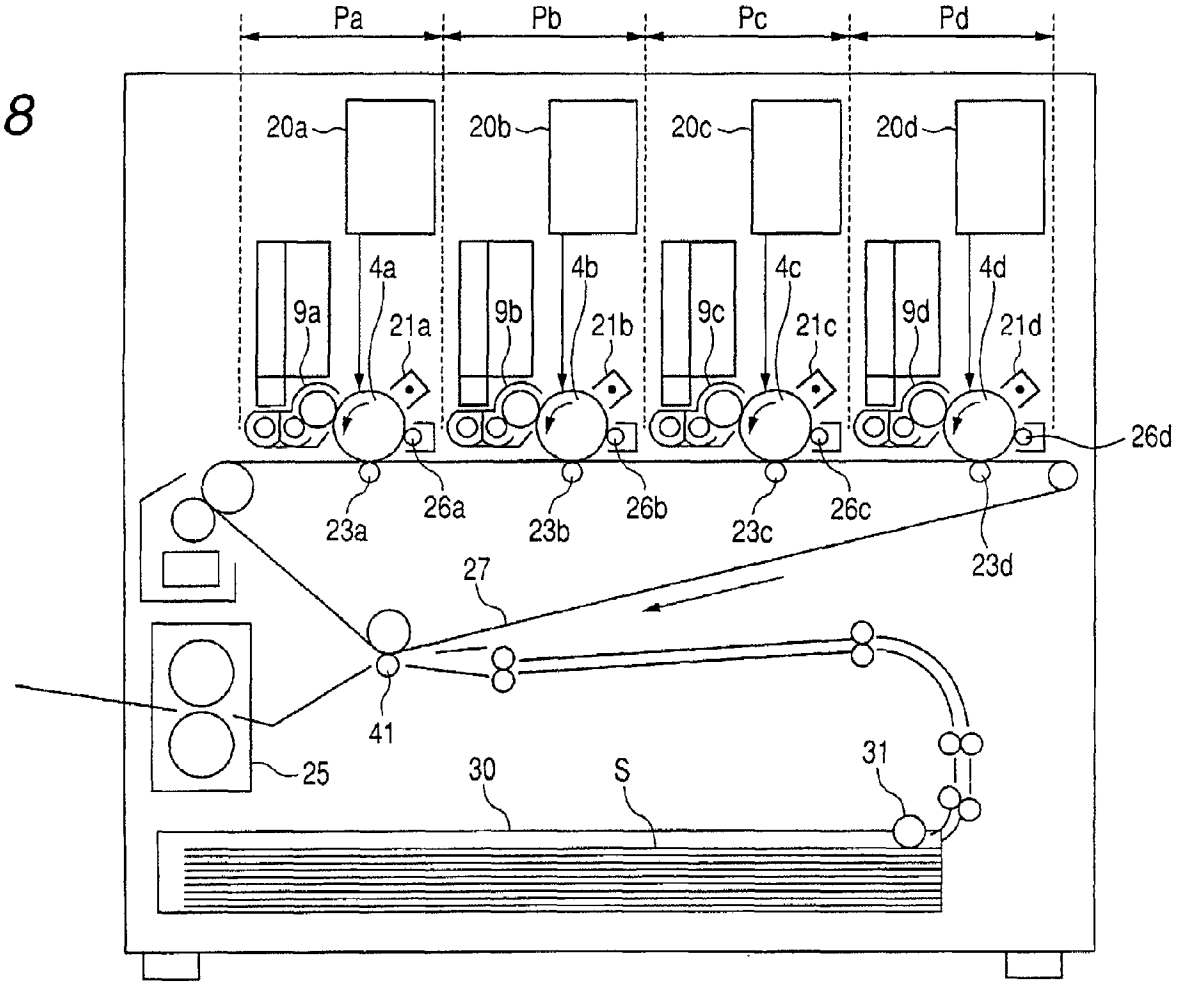
FIG. 18 schematically shows the construction of another embodiment of the image forming apparatus according to the present invention.

The image forming apparatus of the present invention, however, is not restricted to such construction, but may be a color image forming apparatus of a tandem type intermediate transfer type, as shown, for example, in FIG. 18.

That is, in the image forming apparatus 100 according to the present embodiment, four image forming portions i.e., image forming stations P (Pa, Pb, Pc, Pd) are juxtaposed in series in an image feeding direction.

The image forming stations P(Pa, Pb, Pc, Pd) are provided with drum-shaped electrophotographic photosensitive members which are image bearing members, i.e., photosensitive drums 4 (4*a*, 4*b*, 4*c*, 4*d*), charging devices 21 (21*a*, 21*b*, 21*c*, 21*d*) as charging means, exposing devices 20 (20*a*, 20*b*, 20*c*, 20*d*) which are laser beam scanner units as exposing means, developing apparatuses 9 (9*a*, 9*b*, 9*c*, 9*d*) as developing means, cleaning devices 26 (26*a*, 26*b*, 26*c*, 26*d*) as cleaning means, and primary transferring devices 23 (23*a*, 23*b*, 23*c*, 23*d*) which are transfer rollers as primary transferring means.

Also, an intermediate transfer belt 27 which is a belt-shaped intermediate transfer member is disposed for movement in the direction indicated by the arrow so as to pass between the photosensitive drums 4 (4*a*, 4*b*, 4*c*, 4*d*) and the primary transferring devices 23 (23*a*, 23*b*, 23*c*, 23*d*) of the respective image forming stations P (Pa, Pb, Pc, Pd).

Again in such an image forming apparatus, electrostatic latent images according to an image signal are formed on the photosensitive drums 4 (4*a*, 4*b*, 4*c*, 4*d*) by latent image forming means.

The developing apparatus 9 (9*a*, 9*b*, 9*c*, 9*d*) are similar in construction to the developing apparatus 9 described with reference to FIG. 2, and are filled with predetermined amounts of developers composed of mixtures of yellow, magenta, cyan and black nonmagnetic toners and a magnetic carrier mixed together at predetermined mixing ratios. Accordingly, the latent images on the photosensitive drums 4 (4*a*, 4*b*, 4*c*, 4*d*) are successively developed with the toners of the respective colors to thereby form toner images, which are then primary-transferred onto the intermediate transfer belt 27.

Further, transfer sheets S contained in a sheet supplying tray 30 are conveyed one by one to a secondary transfer roller 41 as a secondary transferring device which is secondary transferring means, and the toner image borne on the intermediate transfer belt 27 is secondary-transferred to the transfer sheets S. The transfer sheet S to which the toner image has been transferred has the toner image thereon fixed by heating and pressurizing in a fixing device 25, whereafter it is discharged out of the apparatus as a record image.

The principles of the present invention described in Embodiments 1 to 10 can likewise be applied to the image forming apparatus of the above-described construction, to thereby achieve a similar operational effect.

That is, again by the present embodiment, the quality of image is changed in at least one image forming station P and the developer latitude detecting mode for detecting the latitude of the developer is carried out, whereby the latitude of the developer which is the main factor of the deterioration of an image can be precisely estimated beforehand. Also, it is possible to estimate the latitude of the developer beforehand, and replace the developer in the developer container with a fresh developer at appropriate timing in accordance with the deteriorated state, and images of high quality can be provided stably for a long period, and the rate of operation can be improved and the running cost can be greatly reduced.

Of course, the image forming apparatus of the present invention is not restricted to the color image forming apparatus of the rotary developing type or the tandem type intermediate transfer type described above, but the present invention can likewise be applied to an image forming apparatus of a type having a conveying belt for conveying a transfer sheet, instead of the intermediate transfer belt, and forming an image on this transfer sheet, to thereby achieve a similar operational effect.

This application claims priority from Japanese Patent Application No. 2005-180523 filed Jun. 21, 2005, which is hereby incorporated by reference herein.

What is claimed is:

1. An image forming apparatus comprising:

electrostatic image forming means for forming an electrostatic image on an image bearing member;

a developing apparatus provided with a developer carrying member disposed opposite to said image bearing member and carrying a developer, said developing apparatus performing a development of the electrostatic image by a development bias being applied to said developer carrying member;

distance changing means for changing a closest distance between said image bearing member and said developer carrying member;

density detecting means for detecting a density of a developer image for detection formed by said developing apparatus; and controlling means operable to execute a developer lifetime detecting mode for detecting the developer image for detection formed with the closest distance changed by said distance changing means, by said density detecting means, and informing information regarding a lifetime of the developer based on a detection result by said density detecting means.

2. An image forming apparatus administration system comprising:

an image forming apparatus including:

electrostatic image forming means for forming an electrostatic image on an image bearing member;

a developing apparatus provided with a developer carrying member disposed opposite to said image bearing member and carrying a developer, said developing apparatus performing a development of the electrostatic image by a development bias being applied to said developer carrying member;

distance changing means for changing a closest distance between said image bearing member and said developer carrying member; and density detecting means for detecting a density of a developer image for detection formed, by said developing apparatus;

controlling means operable to execute a developer lifetime detecting mode for detecting the developer image for detection formed with the closest distance changed by said distance changing means, by said density detecting means, and transmitting information regarding a lifetime of the developer based on a detection result by said density detecting means to an administration device through communicating means; and a terminal device for informing the information regarding the lifetime of the developer transmitted from said administration device through said communicating means.

* * * * *